US012680220B2

(12) United States Patent
Bae et al.

(10) Patent No.: US 12,680,220 B2
(45) Date of Patent: Jul. 14, 2026

(54) LAUNDRY DRYER

(71) Applicant: LG Electronics Inc., Seoul (KR)

(72) Inventors: Yeeseok Bae, Seoul (KR); Hoon Chang, Seoul (KR); Kyoungmin Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 862 days.

(21) Appl. No.: 17/920,634

(22) PCT Filed: Apr. 21, 2021

(86) PCT No.: PCT/KR2021/005003
§ 371 (c)(1),
(2) Date: Oct. 21, 2022

(87) PCT Pub. No.: WO2021/215819
PCT Pub. Date: Oct. 28, 2021

(65) Prior Publication Data

US 2023/0144590 A1 May 11, 2023

(30) Foreign Application Priority Data

Apr. 21, 2020 (KR) ..... 10-2020-0047926

(51) Int. Cl.

| | |
|---|---|
| ***D06F 58/20*** | (2006.01) |
| ***D06F 58/04*** | (2006.01) |
| ***D06F 58/24*** | (2006.01) |
| ***D06F 58/26*** | (2006.01) |
| ***F16L 3/00*** | (2006.01) |
| ***F16L 3/02*** | (2006.01) |

(52) U.S. Cl.
CPC ..... *D06F 58/203* (2013.01); *D06F 58/04* (2013.01); *D06F 58/24* (2013.01)

(58) Field of Classification Search
CPC ..... D06F 58/203; D06F 58/20; D06F 58/04; D06F 58/24; D06F 58/26; F16L 3/02; F16L 3/00
USPC ..... 34/411, 552, 568, 79, 378
See application file for complete search history.

(56) References Cited

U.S. PATENT DOCUMENTS

2009/0320318 A1* 12/2009 Kim ..... D06F 58/203 34/499

FOREIGN PATENT DOCUMENTS

CN 105714542 A 6/2016
CN 106222974 A 12/2016
CN 206109828 U * 4/2017
(Continued)

OTHER PUBLICATIONS

DE4205425 by PE2E Jul. 14, 2025.*
(Continued)

*Primary Examiner* — Deming Wan
(74) *Attorney, Agent, or Firm* — Fish & Richardson P.C.

(57) ABSTRACT

The present invention relates to a laundry dryer, and the laundry dryer comprises a steam part for supplying steam into a drum, and a water supply part for supplying water to the steam part, wherein the steam part includes: a steam generator; a steam nozzle for supplying steam into the drum; a steam pipe for connecting the steam generator and the steam nozzle; and an accumulator for separating condensate water from the steam flowing in the steam pipe, and thus prevents the condensate water from being generated in the steam pipe or the steam nozzle and falling into the drum.

20 Claims, 17 Drawing Sheets

(56) References Cited

FOREIGN PATENT DOCUMENTS

| | | | | | |
|---|---|---|---|---|---|
| CN | 108799626 | A | * | 11/2018 | ..... H01M 10/613 |
| CN | 109989240 | A | | 7/2019 | |
| DE | 4205425 | A1 | * | 5/1993 | ..... F02M 35/1211 |
| EP | 2287388 | A1 | * | 2/2011 | ..... D06F 3/02 |
| EP | 2610391 | | | 7/2014 | |
| JP | H11215646 | A | * | 8/1999 | |
| JP | 2012024137 | | | 2/2012 | |
| KR | 20050118481 | | | 12/2005 | |
| KR | 10-0672437 | | | 1/2007 | |
| KR | 10-2011-0067836 | A | | 6/2011 | |
| KR | 10-1430458 | | | 8/2014 | |
| KR | 20150027491 | | | 3/2015 | |
| KR | 20180025094 | | | 3/2018 | |
| WO | WO 2008/058645 | | | 5/2008 | |
| WO | WO2009095318 | | | 8/2009 | |

OTHER PUBLICATIONS

CN 108799626 by PE2E Jul. 14, 2025.*
JPH11215646 by PE2E Jul. 14, 2025.*
CN206109828 by PE2E Jul. 14, 2025.*
EP2287388 by PE2E Jul. 14, 2025.*
Office Action in Chinese Appln. No. 202180029704.X, mailed on Mar. 27, 2025, 14 pages (with English translation).
Office Action in Korean Appln. No. 10-2020-0047926, mailed on Feb. 3, 2025, 7 pages (with English translation).
International Search Report in International Appln. No. PCT/KR2021/005003, dated Aug. 19, 2021, 5 pages (with English translation).
Extended European Search Report in European Appln. No. 21793642.6, mailed on Mar. 12, 2024, 6 pages.
Office Action in Chinese Appln. No. 202180029704.X, mailed on Mar. 12, 2026, 15 pages (with English translation).

* cited by examiner

LAUNDRY DRYER

CROSS-REFERENCE TO RELATED APPLICATIONS

This application is a National Stage application under 35 U.S.C. § 371 of International Application No. PCT/KR2021/005003, filed on Apr. 21, 2021, which claims the benefit of Korean Application No. 10-2020-0047926, filed on Apr. 21, 2020. The disclosures of the prior applications are incorporated by reference in their entirety.

TECHNICAL FIELD

The present disclosure relates to a laundry dryer, and more particularly, to a laundry dryer that sprays high-temperature steam into a drum through a steamer.

BACKGROUND ART

Recently, a laundry treatment apparatus that performs a drying cycle for removing moisture from clothes has been developed. Conventional laundry treatment apparatuses supply hot air to a drum accommodating clothes to dry the clothes, thereby greatly shortening the drying time of clothes, and sterilizing and disinfecting the clothes.

On the other hand, there is also a conventional laundry treatment apparatus that supplies steam to clothes in order to remove wrinkles from the clothes, improve drying efficiency, or perform sterilization.

Korean Patent Registration No. 10-1435823 discloses a laundry treatment apparatus that supplies steam to clothes and then dries the clothes.

The conventional laundry treatment apparatus includes a steam generator, a steam pipe, and a steam nozzle.

However, the steam generated by the steam generator is condensed in the steam pipe or the steam nozzle to cause condensed water, causing a problem in which the condensed water flows down into a drum.

DISCLOSURE

Technical Problem

The present disclosure is intended to solve the problems of the conventional laundry dryer as described above, and an object of the present disclosure is to provide a laundry dryer that prevents condensed water from flowing down into a drum due to generation of condensed water in a steam pipe or a steam nozzle.

Technical Solution

According to an embodiment, a laundry dryer includes a drum rotatably installed in a cabinet forming an appearance and accommodating a subject to be dried, a duct configured to re-supply air discharged from the drum to the drum, a circulation fan configured to provide a flow force to air moving along the duct, a heat exchanger provided on the duct and performing heat exchange with air circulated along the duct, a steamer configured to supply steam into the drum, and a water supplier including a water supply tube that supplies water to the steamer.

The steamer may include a steam generator configured to receive water from the water supplier and generate steam by heating the received water, a steam nozzle connected to the steam generator and supplying steam into the drum, the steam being introduced from the steam generator, a steam pipe connecting the steam generator and the steam nozzle, steam generated by the steam generator flowing through the steam pipe, and an accumulator installed on the steam pipe and separating condensed water from the steam flowing through the steam pipe.

The accumulator may include a base having a space formed therein to accommodate condensed water separated from steam, a cover coupled to the base to form a flow path through which steam flows, and a supporter extending to protrude from an outer surface of the base to hold an outer peripheral surface of the water supply tube.

The base may include a base body formed to have a box shape, and a condensate separator plate formed inside the base body and extending to protrude upward from a bottom surface of the base body.

The steam pipe may include a first steam pipe connecting the steam generator and the accumulator, and a second steam pipe connecting the accumulator and the steam nozzle.

The base may include an inlet port extending to protrude from one outer surface of the base body and inserted into the first steam pipe, steam generated by the steam generator being introduced through the inlet port, and an outlet port extending to protrude from the other outer surface of the base body, inserted into the second steam pipe, and discharging steam from which condensed water has been separated to the steam nozzle.

The output port may be disposed at a position higher than the inlet port with respect to the bottom surface of the base body.

The inlet port may be disposed such that a portion of an inner peripheral surface of the inlet port is located lower than the bottom surface of the base body in a gravity direction.

The supporter may include a support plate extending to protrude from an outer surface of the base body and being in surface contact with an outer peripheral surface of the water supply tube.

The base body may include a first side disposed in a direction in which steam is introduced, a second side disposed in a direction in which steam is discharged, and a third side connecting the first side and the second side.

The support plate may include an upper support plate including an upper contact surface formed to have a curved surface to be in surface contact with an upper portion of the outer peripheral surface of the water supply tube, and extending to protrude from an outer surface of the third side.

The upper support plate may further include a protrusion extending to protrude from the third side.

The upper contact surface may be formed to extend to be curved at an outer end of the protrusion.

The upper support plate may be bent and extended upward from an outer end of the upper contact surface to guide assembly of the water supply tube.

The support plate may include a lower support plate including a lower contact surface formed to have a curved surface to be in surface contact with a lower portion of the outer peripheral surface of the water supply tube, and extending to protrude from a lower surface of the bottom surface.

The lower support plate may further include a lower supporter formed to extend from the bottom surface and the third side and connected to the lower contact surface to support the lower contact surface.

The base may include a cover coupling protrusion formed to protrude from the outer surface of the base body so as to be hook-coupled with the cover.

The cover may include a cover body configured to cover the base and forming a flow path through which steam flows, and a coupler formed to extend from a sidewall of the cover body and having a hook receiving hole for accommodating the cover coupling protrusion.

The laundry dryer may further include an upper fame disposed on an upper side of the drum and supporting the cabinet.

The accumulator may include a fixing portion formed to extend downward from the bottom surface of the base to support the base and coupled to the upper frame.

The fixing portion may include a height adjustment portion extending downward from the bottom surface and adjusting a height of the base to guide a direction of flow of steam and condensed water, and a fixing plate extending to protrude from a sidewall surface of the height adjustment portion and having a fixing hole for being fixedly coupled to the upper frame.

The accumulator may further include an assembly hook extending downward from a lower portion of the supporter and supported by being caught by the upper frame.

The supporter comprises a lower support plate extending to protrude from an outer surface of the base body and formed on a same plane as the lower surface of the bottom surface.

The supporter may include an upper support plate protruding from the lower support plate and extending while forming a curved surface to surround an upper outer peripheral surface of the water supply tube.

The condensate separator plate may include a first separator plate formed to be inclined at a predetermined angle with a sidewall surface of the base body to guide flow of steam generated by the steam generator, a second separator plate formed to be inclined at a predetermined angle with the sidewall surface of the base body to guide flow of steam discharged to the steam nozzle, and a third separator plate disposed between the first separator plate and the second separator plate and formed to have a curved shape.

Advantageous Effect

As described above, according to the laundry dryer according to the present disclosure, an accumulator is provided on the steam pipe to prevent condensed water generated from the steam pipe or the steam nozzle from flowing down into the drum.

MODE FOR INVENTION

Figure 1:
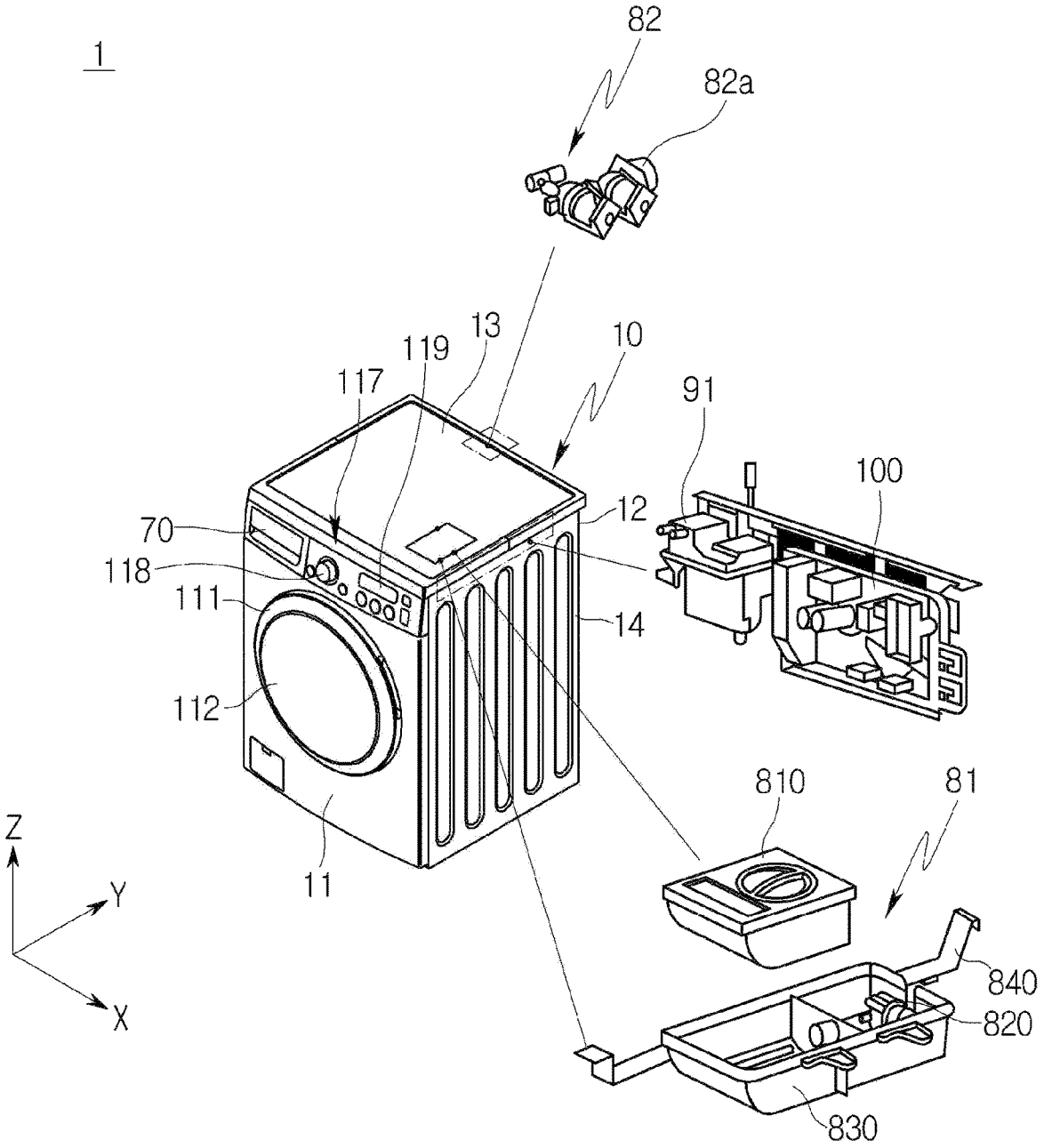
FIG. 1 is a view for describing an external appearance of a laundry dryer according to an embodiment of the present disclosure.

Hereinafter, preferred embodiments of the present disclosure will be described in detail with reference to the accompanying drawings.

Since the present disclosure can have various changes and various embodiments, specific embodiments are illustrated in the drawings and will be described in detail in the detailed description. This is not intended to limit the present disclosure to specific embodiments, and should be construed to include all modifications, equivalents, and substitutes included in the spirit and scope of the present disclosure.

In describing the present disclosure, terms such as first, second, etc. may be used to describe various components, but the components may not be limited by the terms. The terms are used merely for the purpose to distinguish a component from the other component. For example, a first component may be referred to as a second component without departing from the scope of the present disclosure, and likewise a second component may be referred to as a first component.

The term "and/or" includes any and all combination of one or more of the related listed items.

When an element is referred to as being "connected to" or "coupled with" another element, not only it can be directly connected or coupled to the other element, but also it can be understood that intervening elements may be present. In contrast, when an element is referred to as being "directly connected to" or "directly coupled with" another element, there are no intervening elements present.

The terminology used herein is for the purpose of describing particular embodiments only and is not intended to limit the present disclosure. As used herein, the singular form is intended to include the plural form as well, unless the context clearly indicates otherwise.

It will be further understood that the terms "comprise" and/or "have," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, the following embodiments are provided to more completely explain to those of ordinary skill in the art, and the shapes and sizes of elements in the drawings may be exaggerated for clearer explanation.

Figure 2:
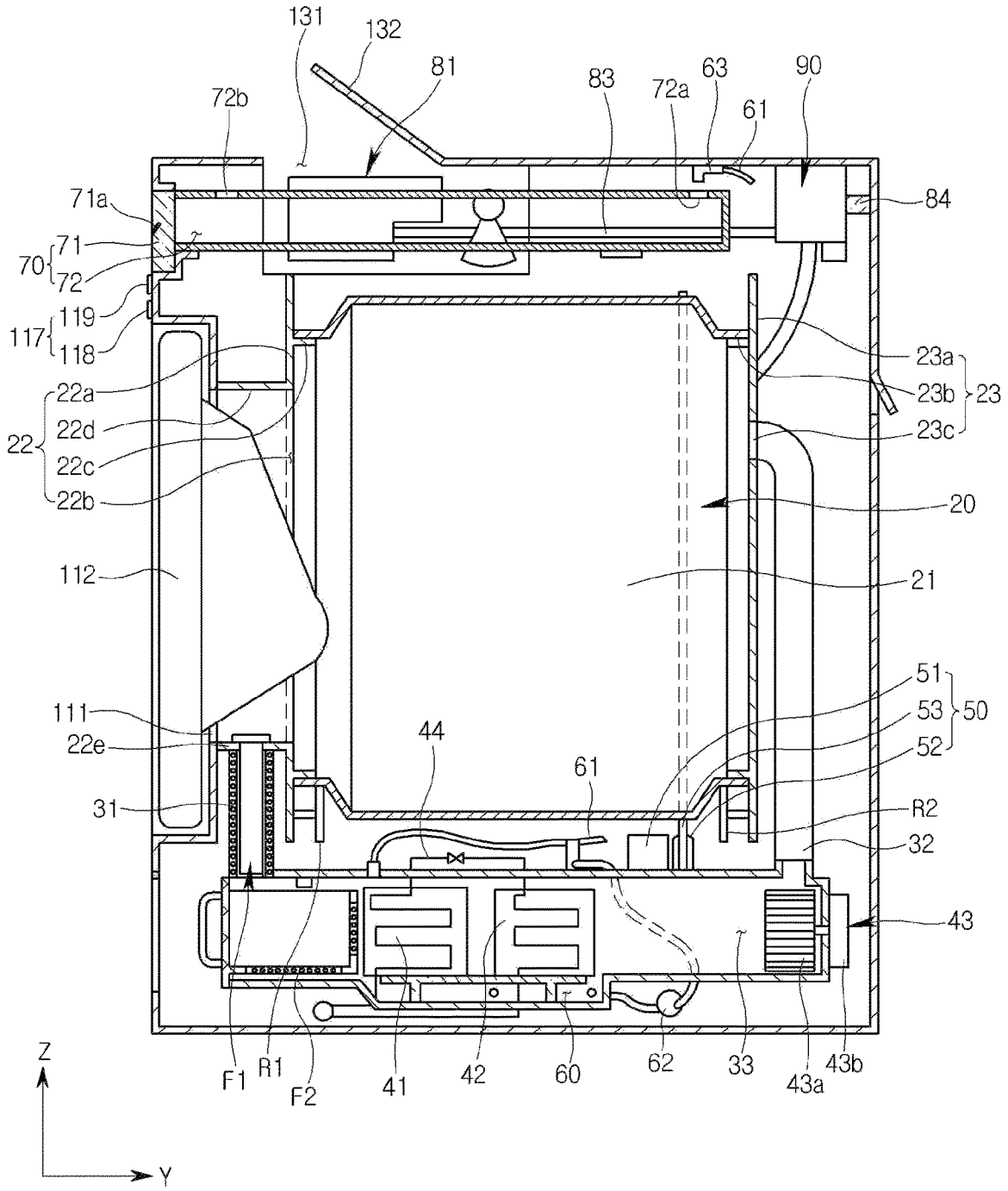
FIG. 2 is a cross-sectional view for describing an internal structure of a laundry dryer according to an embodiment of the present disclosure.

FIG. 1 is a view for describing external appearance of a laundry dryer according to an embodiment of the present disclosure, and FIG. 2 is a cross-sectional view for describing internal structure of a laundry dryer according to an embodiment of the present disclosure.

Referring to FIGS. 1 and 2, a cabinet 10 forming an external body of the laundry dryer 1 includes a front panel 11 forming the front surface of the laundry dryer 1, a rear panel 12 forming the rear surface of the laundry dryer 1, a pair of side panels 14 forming the sides of the laundry dryer 1, and an upper panel 13 forming the upper surface of the laundry dryer 1.

An inlet 111 provided to communicate with a drum 20 to be described later and a door 112 coupled to the cabinet 10 to open and close the inlet 111 may be disposed on the front panel 11.

A control panel 117 is provided on an upper portion of the front panel 11.

The control panel 117 may be provided with an input portion 118 to receive a control command from the user, a display 119 to output information such as the control command selectable by the user, and a main controller (not shown) to control a command for performing the operation of the laundry dryer 1.

On the other hand, the input portion 118 may be configured to include a power supply request portion to request power supply to the laundry dryer, a course input portion to allow the user to select a desired course among a plurality of courses, an execution request portion to request the start of the course selected by the user, and the like.

The display 119 may be configured to include at least one of a display panel or a light emitting diode panel capable of outputting characters and/or figures, and a speaker capable of outputting a voice signal and sound. The user can easily grasp the status of a current administrative status, a remaining time, and the like through the information output through the display 119.

A drum 20 that is rotatably provided inside the cabinet 10 and provides a space for receiving clothes (a subject to be dried), a duct 30 that forms a flow path for re-supplying the air discharged from the drum 20 to the drum 20, and a heat exchanger 40 that dehumidifies and heats air introduced into the duct 30 and then re-supplies the air to the drum 20 are provided inside the cabinet 10.

The drum 20 may include a cylindrical drum body 21 having an open front surface, a first supporter 22 rotatably supporting the front surface of the drum body 21 inside the cabinet 10, and a second supporter 23 rotatably supporting the rear surface of the drum body 21.

The first supporter 22 may be configured to include a first fixed body 22*a* that is fixed to the inside of the cabinet 10, a drum inlet 22*b* that is provided to pass through the first fixed body 22*a* to communicate the inlet 111 and the inside of the drum body 21, and a first support body 22*c* that is provided in the first fixed body 22*a* and is inserted into the front surface of the drum body 21.

The first supporter 22 may be configured to further include a connection body 22*d* connecting the inlet 111 and the drum inlet 22*b*. As shown in drawings, the connection body 22*d* may be provided in a pipe shape extending from the drum inlet 22*b* toward the inlet 111. In addition, the connection body 22*d* may be provided with an air outlet 22*e* communicating with the duct 30.

As shown in FIG. 2, the air outlet 22*e* is a passage for allowing the internal air of the drum body 21 to move to the duct 30, and it may be provided as a through hole provided to pass through the connection body 22*d*.

The second supporter 23 is configured to include a second fixed body 23*a* that is fixed inside the cabinet 10 and a second support body 23*b* that is provided in the second fixed body 23*a* and inserted into the rear surface of the drum body 21.

The second supporter 23 is provided with an air inlet 23*c* provided to pass through the second fixed body 23*a* to communicate the inside of the drum body 21 with the inside of the cabinet 10.

In this case, the duct 30 is configured to connect the air outlet 22*e* and the air inlet 23*c*.

The cylindrical drum body 21 may rotate through various types of the driver 50.

For example, an embodiment in which the driver 50 includes a drum motor 51 fixed inside the cabinet 10, a pulley 52 rotated by the drum motor 51, and a belt 53 connecting the circumferential surface of the pulley 52 and the circumferential surface of the drum body 21 is shown in FIG. 2.

In this case, the first supporter 22 may be provided with a first roller R1 that rotatably supports the circumferential surface of the drum body 21, and the second supporter 23 may be provided with a second roller R2 that rotatably supports the circumferential surface of the drum body 21.

However, the present disclosure is not limited thereto, and a direct drive type driver in which the drum motor 51 is directly connected to the drum without going through the pulley and the belt to rotate the drum is also applicable, which naturally falls within the scope of the present disclosure. For convenience, the following description will be given based on embodiments of the driver 50 illustrated.

The duct 30 includes an exhaust duct 31 connected to the air outlet 22*e*, a supply duct 32 connected to the air inlet 23*c*, and a connection duct 33 configured to connect the exhaust duct 31 and the supply duct 32 and including a heat exchanger 40 installed in the connection duct 33.

The heat exchanger 40 may be provided with various devices capable of sequentially dehumidifying and heating the air introduced into the duct 30. For example, the heat exchanger 40 may be provided as a heat pump system.

As a heat pump system, the heat exchanger 40 may include a circulation fan 43 that moves air along the duct 30, a first heat exchanger (heat absorber) 41 configured to perform a dehumidification function by lowering the humidity of air introduced into the duct 30, and a second heat exchanger (heat generator) 42 provided inside the duct 30 to heat the air that has passed through the first heat exchanger 41.

The circulation fan 43 is provided to include the impeller 43*a* provided in the duct 30, and an impeller motor 43*b* to rotate the impeller 33*a*, and provides a flow force to the air moving along the duct 31.

The impeller 43*a* may be installed at any position among the exhaust duct 31, the connection duct 33, and the supply duct 32, and in FIG. 2, there is illustrated an embodiment in which the impeller 43*a* is provided in the connection duct 32. The present disclosure is not limited thereto, but for convenience, the following description will be made based on the embodiment in which the impeller 43*a* is provided in the connection duct 32.

The heat exchanger 40 may be subjected to exchange heat with air circulated along the duct 30.

The heat absorber 41 and the heat generator 42 are sequentially arranged in the direction from the exhaust duct 31 to the supply duct 32 in the inside of the connection duct 33, and may connect to each other through a refrigerant pipe 44 that forms a circulation path of the refrigerant is connected to each other.

The heat absorber 41 is a means for cooling air and evaporating refrigerant by transferring the heat of air introduced into the exhaust duct 31 to the refrigerant.

The heat generating unit 42 is a means for heating air and condensing refrigerant by transferring the heat of the refrigerant that has passed through the compressor 45 to the air.

The compressor 45 may receive a rotational force by the compressor motor 45*a* and compress refrigerant subjected to heat exchange with air circulated along the duct 30.

In this case, when moisture contained in the air passes through the heat absorber 41, the moisture is collected on the bottom surface of the connection duct 33 while moving along the surface of the heat absorber 41.

A configuration already known in the art is applicable as the configuration of the heat exchanger 40 with the heat pump system as described above, including the heat absorber 41 and the heat generator 42, and applicable and a description of the detailed configuration thereof will be omitted.

On the other hand, the laundry dryer 1 according to the present disclosure may include a water collector 60 to collect the condensed water condensed from air passing through the heat absorber 41 and collected on the bottom surface of the connection duct 33.

The condensed water condensed in the heat absorber 41 may be first collected in the water collector 60, and then may be secondarily collected in a water storage 70. The water collector 60 may be located inside the connection duct 33 as shown, or may be separately provided in a space spaced apart from the connection duct 33.

The condensed water first collected through the water collector 60 is supplied to the water storage 70 through a condensed water supply pipe 61. In this case, the condensed water supply pipe 61 is provided with a condensed water pump 62 for smooth discharge of the condensed water.

The water storage 70 may include a water storage tank 72 provided to be withdrawn from one side of the front panel 11 to the outside. The water storage tank 72 is configured to collect the condensed water transferred from the water collector 60 to be described later.

A user can remove the condensed water by withdrawing the water storage tank 72 from the cabinet 10, and then re-install the water storage tank 72 in the cabinet 10. As a result, the laundry dryer 1 according to the present disclosure may be disposed at any place where a sewer or the like is not installed.

In more detail, the water storage 70 may include a water storage tank 72 that is detachably provided in the cabinet 10 to provide a space for storing water, and an inlet 72*a* provided to pass through the water storage tank 72 to introduce water discharged from the condensed water supply pipe 61 into the water storage tank 72.

The water storage tank 72 may be provided as a tank in the form of a drawer capable of being drawn out from the cabinet 10. In this case, the front panel 11 of the cabinet is provided with a water storage mounting hole into which the water storage tank 72 is inserted.

A panel 71 is fixed to the front surface of the water storage tank 72, and the panel 71 may be detachably coupled to the water storage mounting hole to form a part of the front panel 11.

The panel 71 may further include a groove 71*a* into which a user's hand is inserted for grip. In this case, the panel 71 may also function as a handle for withdrawing the water storage tank 72 from the cabinet or inserting the water storage tank 72 into the cabinet.

The inlet 72*a* is formed to receive the condensed water discharged from a condensate nozzle 63 fixed to the cabinet 10. The condensate nozzle 63 may be fixed to the upper panel 13 of the cabinet 10 such that the water storage tank 72 is positioned above the inlet 72*a* when the water storage tank 72 is inserted into the cabinet 10.

The user can discard the water inside the water storage tank 72 by withdrawing the water storage tank 72 from the cabinet 10 and then turning or tilting the water storage tank 72 toward the direction in which the inlet 72*a* is located. A communication hole 72*b* to pass through the upper surface of the water storage tank 72 may be further provided to allow the water inside the water storage tank 72 to be easily discharged through the inlet 72*a*.

In addition, the laundry dryer 1 according to the present disclosure may include a first filter F1 and a second filter F2 as a means for removing foreign substances such as lint and dust generated in the drying process of laundry such as clothes.

The first filter F1 is provided in the exhaust duct 31 to primarily filter foreign substances contained in the air discharged from the drum 20.

The second filter F2 is disposed on the downstream side of the first filter F1 in the flow direction of air so as to secondarily filter out foreign substances contained in the air that has passed through the first filter F1. Specifically, as shown in drawings, it is preferable that the second filter F2 be disposed on the upstream side of the first heat exchanger 41 in the inside of the connection duct 33. The reason for this is to prevent foreign substances contained in the air from accumulating in the first heat exchanger 41 acting as a heat absorber to contaminate the first heat exchanger 41 or to cause deterioration in performance.

As for the detailed configuration of the first filter F1 and the second filter F2, any means known in the art may be applied, and a description of the detailed configuration thereof will be omitted.

On the other hand, laundry dryer 1 according to the present disclosure may further include a water supplier 80 including an internal water supplier 81 and an external water supplier 82, and a steamer 90 that receives water from the water supplier 80 to generate steam.

The steamer 90 may be provided to generate steam by receiving fresh water instead of condensed water. The steamer 90 may include a steam generator 91, a steam pipe 92, a steam nozzle 93, and an accumulator 94.

The steam generator 91 may receive water from the water supplier 80 and heat the supplied water to generate steam. A piping structure through which water flows into the steam generator 91 and steam is discharged will be described later.

Although it is described in the present embodiment that the steam generator 91 heats a predetermined amount of water contained therein with a heater (not shown) to generate steam (hereinafter referred to as 'container heating method' for convenience), the present disclosure is limited thereto.

Steam generated by the steam generator 91 may be introduced into the steam nozzle 93, and the steam may be sprayed into the drum 20.

The steam pipe 92 may connect the steam generator 91 and the steam nozzle 93, and have a flow path through which steam can flow in the steam pipe 92. Accordingly, the steam generated by the steam generator 91 may flow along the steam pipe 92 and be discharged into the drum 20 through the steam nozzle 93.

In this case, the steam generated from the steam generator 91 may be condensed in the steam pipe 92 or the steam nozzle 93 to generate condensed water, causing a problem in which the condensed water may flow down into the drum 20.

To solve this problem, the present disclosure may include an accumulator 200 capable of separating condensed water from steam.

The accumulator 200 is installed on the steam pipe 92 to separate condensed water from steam, when the steam generated from the steam generator 91 is condensed in the steam pipe 92 to become condensed water. Specifically, the accumulator 200 may be connected to a first steam pipe 921 and a second steam pipe 922 to separate condensed water mixed with steam. In this case, the condensed water may be introduced back into the steam generator 200 or into the water collector 60 (see FIG. 7).

A detailed configuration of the accumulator 200 will be described later.

The steamer 90 may be controlled to receive water through the external water supplier 82 as well as the internal water supplier 81 as needed and supply steam to the inside of the drum body 21.

The external water supplier 82 may include a direct water valve 82*a* adjacent to the rear panel 13 or fixed to the rear panel 13, and a water supply tube 84 configured to supply water transferred from the direct water valve 82*a* to the steamer 90.

The direct water valve 82*a* may be coupled to an external water supply source. For example, the direct water valve 82*a* may be coupled to a water supply pipe (not shown) extending to the rear surface of the cabinet. Accordingly, the steamer 90 may be provided to receive water directly through the direct water valve 82*a*.

Therefore, even when the internal water supplier 81 is omitted or water is not stored in the internal water supplier 81, the steamer 90 may receive water for steam generation through the direct water valve 82*a* when necessary.

The direct water valve 82*a* may be directly controlled by the controller 100.

The controller 100 may be installed on the control panel 117, but as shown in FIG. 1, the controller 100 may be provided as a separate control panel to prevent overload of the control panel 117 and increase in the manufacturing cost.

In this case, the controller 100 may be provided adjacent to the steamer 90. The controller 100 is provided on the side panel 14 on which the steamer 90 is installed to reduce the length of a control line or the like connected to the steamer 90.

On the other hand, the steamer 90 is preferably installed adjacent to the direct water valve 82*a*. Accordingly, it is possible to prevent unnecessary residual water from remaining in a direct water pipe 82*b*, and water may be supplied immediately when necessary.

On the other hand, the internal water supplier 81 includes a storage tank 810 that stores water, a supply pump 820 that receives water from the storage tank 810 and transfers water to the steamer 90, a tank housing 830 that provides a space for accommodating the storage tank 810 and the supply pump 820, and an internal water supply tube 83 that connects the supply pump 820 and the steamer 90 and has a flow path through which water is able to flows.

Accordingly, the internal water supplier 81 is configured to supply stored water to the steamer. That is, the water stored in the storage tank 810 may be supplied to the steamer 90 along an internal water supply tube 83 by the operation of the supply pump 820.

Figure 3:
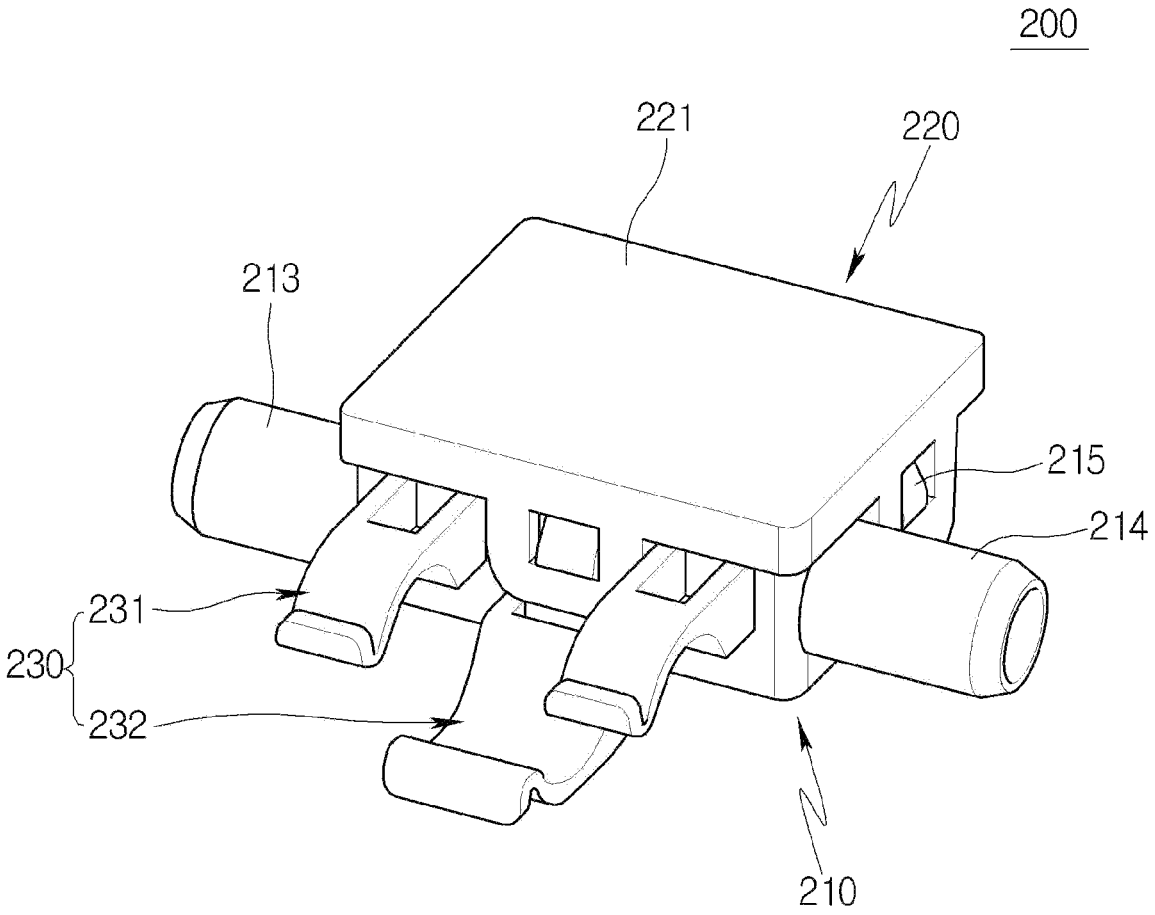
FIG. 3 is a perspective view for describing a structure of an accumulator in a laundry dryer according to an embodiment of the present disclosure.
Figure 4:
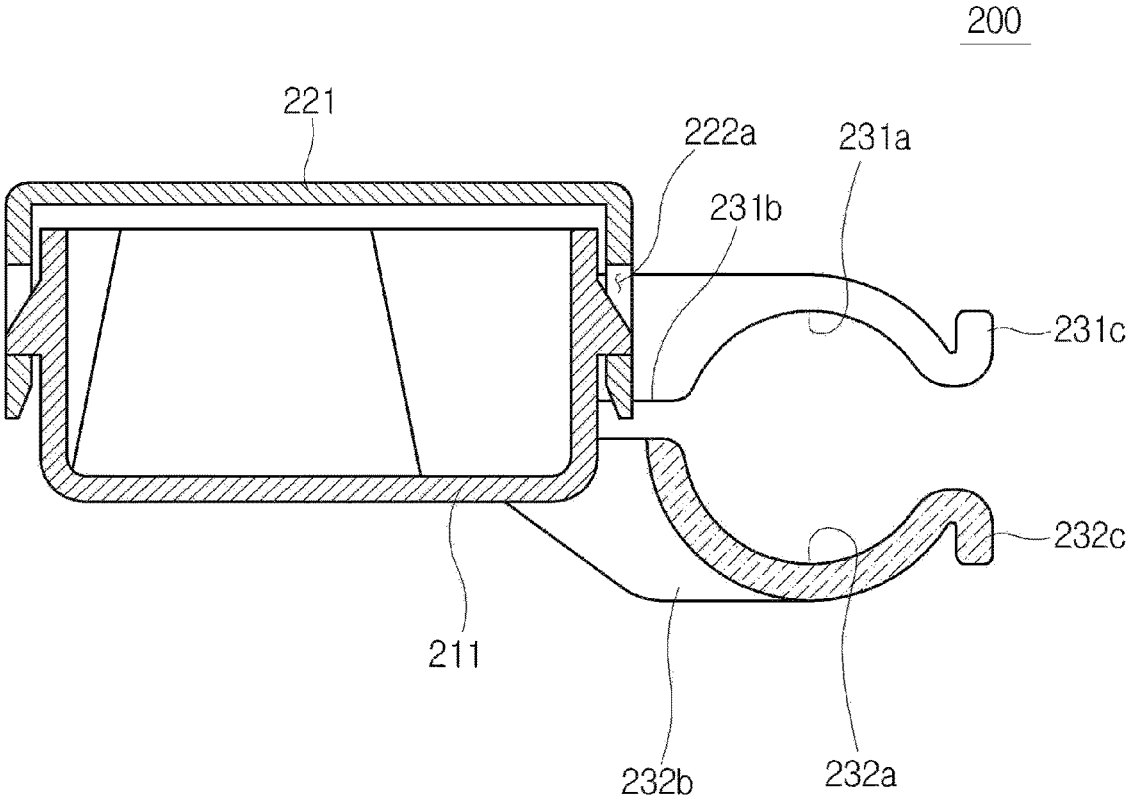
FIG. 4 is a cross-sectional view for describing an accumulator in a laundry dryer according to an embodiment of the present disclosure.
Figure 5:
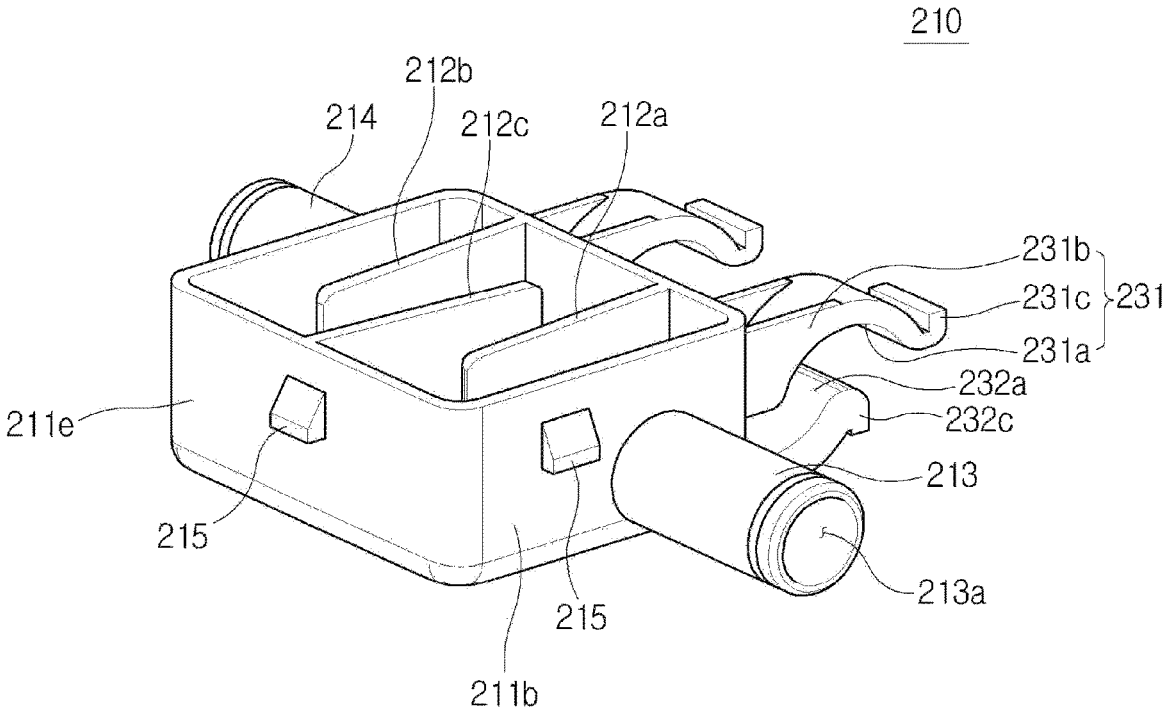
FIG. 5 is a perspective view for describing a base of an accumulator in a laundry dryer according to an embodiment of the present disclosure.
Figure 6:
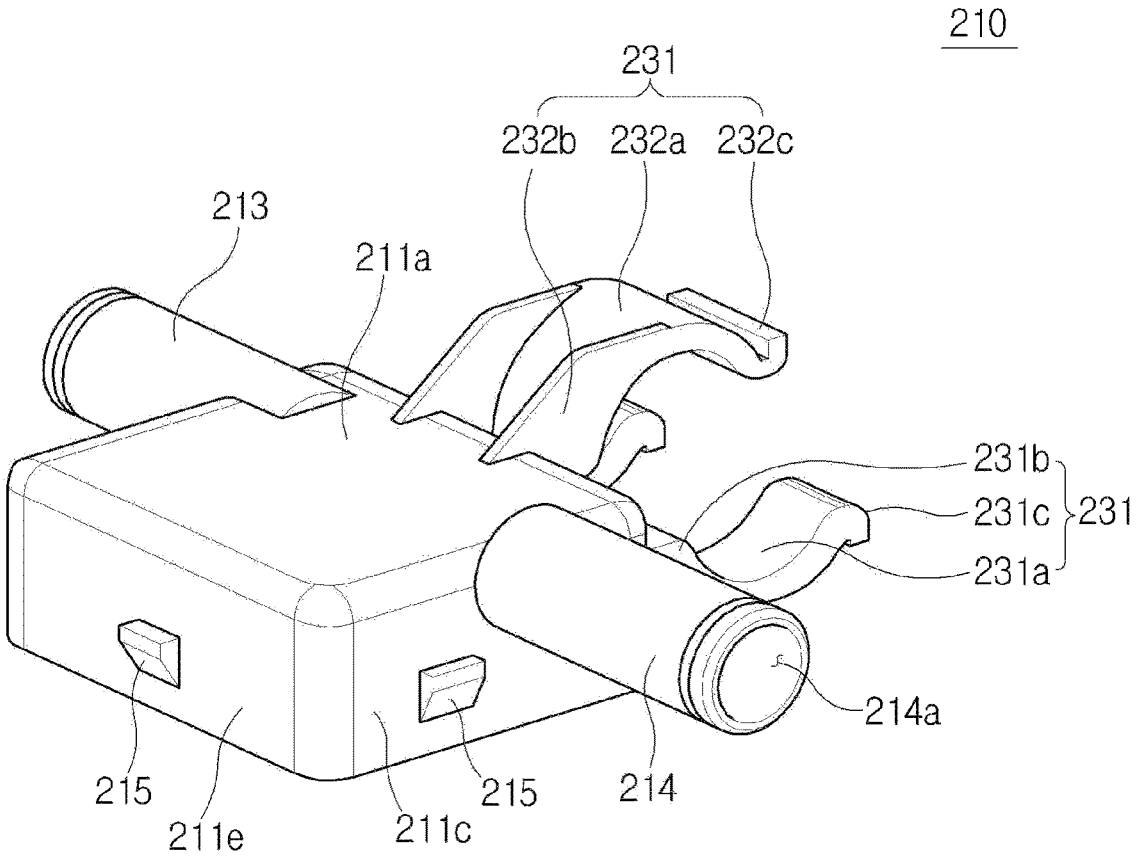
FIG. 6 is a perspective view showing the base of the accumulator in the laundry dryer according to the embodiment of the present disclosure when viewed from another direction.

FIG. 3 is a perspective view for describing a structure of an accumulator in a laundry dryer according to an embodiment of the present disclosure, FIG. 4 is a cross-sectional view for describing an accumulator in a laundry dryer according to an embodiment of the present disclosure, FIG. 5 is a perspective view for describing a base of an accumulator in a laundry dryer according to an embodiment of the present disclosure, and FIG. 6 is a perspective view showing the base of the accumulator in the laundry dryer according to the embodiment of the present disclosure when viewed from another direction.

An accumulator according to an embodiment of the present disclosure will be described with reference to FIGS. 3 to 6.

An accumulator 200 of the present disclosure is installed on the steam pipe 92 and supported by holding the water supply tube 84 of the water supplier 80 to separate condensed water from the steam flowing along the steam pipe 92.

In this case, the accumulator 200 of the present disclosure may include a base 210, a cover 220, and a supporter 230.

The base 210 may form a lower case of the accumulator 200 of the present disclosure, and a space for storing condensed water separated from steam may be formed in the base 210.

Specifically, the base 210 may include a base body 211, a condensate separator plate 212, an inlet port 213, an outlet port, and a cover coupling protrusion 215.

The base body 211 may form a lower exterior of the accumulator 200. For example, the base body 211 may be formed in a box shape.

Specifically, the base body 211 may have a bottom surface 211*a* formed on the lower side in the direction of gravity, and the outer ends of the bottom surface 211*a* may be connected while a first side 211*b*, a second side 211*c*, a third side 211*d* and a fourth side 211*e* surround the bottom surface 211*a*. That is, a side wall made of the first side 211*b*, the second side 211*c*, the third side 211*d* and the fourth side 211*e* is formed at the outer ends of the bottom surface 211*a* to form a space capable of storing or receiving condensed water.

For example, the first side 211*b* may refer to a surface disposed in a direction in which steam is introduced. That is, the inlet port 213 is formed in the first side 211*b*, through which steam and condensed water discharged from the steam generator 91 may be introduced.

In addition, the second side 211*c* may refer to a surface disposed in a direction in which steam is discharged. That is, the outlet port 214 is formed in the second side 211*c*, through which steam may be discharged toward the steam nozzle 93.

The third side 211*d* may refer to a surface connecting the first side 211*b* and the second side 211*c*, and the supporter 230 may be formed to protrude from the outer surface. Meanwhile, the inner surface of the third side 211*d* may be connected to the condensate separator plate 212.

The fourth side 211*e* may refer to a surface that connects the first side 211*b* and the second side 211*c* and is disposed at a position facing the third side 211*d*. Meanwhile, the inner surface of the fourth side 211*e* may be connected to the condensate separator plate 212.

The condensate separator plate 212 may be formed inside the base body 211 and may extend to protrude upward from the bottom surface 211*a* of the base body 211.

As an example, the condensate separator plate 212 may include three separator plates extending to protrude from the bottom surface 211*a*. Specifically, the condensate separator plate 212 may include a first separator plate 212*a* and a second separator plate 212*b* connected to the third side 211*d*, and a third separator plate 212*c* connected to the fourth side 211*e*.

In this case, the condensate separator plate 212 may be formed to be inclined at a predetermined angle from the third side 211*d* or the fourth side 211*e*.

For example, the first separator plate 212*a* may be formed to be inclined at a predetermined angle with respect to the third side 211*d* such that a gap between the first side 211*b* and the first separator plate 212*a* is gradually narrowed along a steam flow direction. In addition, the second separator plate 212*a* may be formed to be inclined at a predetermined angle with respect to the third side 211*d* such that a gap between the second side 211*c* and the second separator plate 212*b* is gradually narrowed along a steam flow direction. Meanwhile, the third separator plate 212*c* may be formed perpendicular to the fourth side 211*e*.

By the configuration described above, the cross-sectional area of a flow path through which the steam introduced through the inlet port 213 passes may be continuously changed. Accordingly, the flow rate of steam may be changed, adiabatic expansion or compression may occur, and efficiency of separation of condensed water which is contained in steam may be improved.

The inlet port 213 extends to protrude from one outer surface of the base body 211 and is inserted into the first steam pipe 921, and steam generated from the steam generator 91 may be introduced into the inlet port 213.

For example, the inlet port 213 extends to protrude from the first side 211*b* in a cylindrical shape, and a steam inlet flow path 213*a* is formed in the inlet port 213 such that steam generated from the steam generator 91 is introduced into the space inside the base body 211.

In this case, a portion of an inner peripheral surface of the inlet port 213 may be disposed lower than the bottom surface 211*a* in the gravity direction. Specifically, a portion of the steam inlet flow path 213*a* formed inside the inlet port 213 may be formed below the bottom surface 211*a*.

Accordingly, gaseous steam may be introduced into the internal space of the base body 211 through the steam inlet flow path 213*a*. On the other hand, condensed water, which is separated from steam and collected (or condensed) in the internal space of the base body 211, may flow toward the steam generator 91 along the steam inlet flow path 213*a* by gravity again, and be then recovered in the steam generator 91.

The outlet port 214 extends to protrude from the other outer surface of the base body 211 and is inserted into the second steam pipe 922, and the steam from which the condensed water has been separated may be discharged to the steam nozzle 93.

For example, the outlet port 214 is formed to protrude from the second side 211*c* in a cylindrical shape, and a steam discharge flow path 214*a* is formed in the outlet port 214 such that the steam from which the condensed water has been separated is discharged toward the steam nozzle 93.

In this case, the outlet port 214 may be disposed higher than the inlet port 213. Specifically, the outlet port 214 may be disposed higher than the inlet port 213 in the gravity direction with respect to the bottom surface 211*a*, and a steam discharge flow path 214*a* may be formed higher than the steam inlet flow path 213*a*.

Accordingly, gaseous steam may be discharged through the steam discharge flow path 214*a*. On the other hand, the condensed water may not pass through the steam discharge flow path 214*a* and may be collected in the internal space of the base body 211 by gravity. Therefore, the condensed water may be blocked from being discharged toward the steam nozzle 93 by the configuration as described above.

Meanwhile, the cover coupling protrusion 215 may protrude from the outer surface of the side wall of the base body 211 and be coupled to the cover 220. For example, the cover coupling protrusion 215 may protrude from the first side 211*b*, the second side 211*c*, the third side 211*d*, and the fourth side 211*e*, individually. According to the embodiment, the cover coupling protrusion 215 may be formed to protrude from the first side 211*b* and the second side 211*c*, and may be formed to protrude from the third side 211*d* and the fourth side 211*e*. In this case, in the present embodiment, the cover coupling protrusion 215 may include an inclined surface to be hook-coupled with the cover 220.

Meanwhile, the cover 220 of the present disclosure may be coupled to the base 210 to form a flow path through which steam flows.

The cover 220 may form an upper case of the accumulator 200 of the present disclosure.

The cover 220 may include a cover body 221 and a coupler 222. Specifically, the cover 220 may include a cover body 221 configured to cover the base 210 to form a flow path through which steam flows, and a coupler 222 extending from the sidewall of the cover body 221 and having a hook receiving hole 222*a* that accommodates the cover coupling protrusion 215.

As an example, the cover body 221 may be formed in the form of a box open downward, and may be formed to have a width and length greater than the width and length of the base 210 such that the base 210 is fitted and coupled to the cover body 221. In this case, the coupler 222 may extend downward from the front end of the side wall of the cover body 221. Meanwhile, the hook receiving hole 222*a* may be formed in a square hole shape to accommodate the cover coupling protrusion 215.

By the configuration described above, the cover 220 is coupled to the base 210 to form a space in which steam flows, thus preventing the steam from leaking to the outside.

In particular, in the present disclosure, a sealing member is further included in the cover 220 so that the space between the cover 220 and the base 210 may be sealed to prevent steam from leaking to the outside.

The supporter 230 of the present disclosure may extend to protrude from the outer surface of the base 210 to hold the outer peripheral surface of the water supply tube 84. For example, the supporter 230 may extend to protrude from the outer surface of the third side 211*d*, and may be formed such that the water supply tube 84 is inserted into the supporter 230 be supported by each other.

The supporter 230 may include support plates 231 and 232 which are in contact with the outer peripheral surface of the water supply tube 84. Specifically, the supporter 230 may include an upper support plate 231 in contact with an upper portion of the outer peripheral surface of the water supply tube 84 and a lower support plate 232 in contact with a lower portion of the outer peripheral surface of the water supply tube 84.

As an example, two upper support plates 231 may be formed parallel to each other on the third side 211*d*, and may include an upper contact surface 231*a* formed to have a curved surface so as to be in surface contact with the upper portion of the outer peripheral surface of the water supply tube 84. In this case, the upper contact surface 231*a* may be formed to have a curvature corresponding to the curvature of the outer peripheral surface of the water supply tube 84.

In addition, the upper support plate 231 may extend to protrude from the third side 211*d* and may further include a protrusion 231*b* connected to the upper contact surface 231*a*. In this case, the protrusion 231*b* may extend to protrude from the third side 211*d* in the vertical direction, and two protrusions 231*b* may constitute a pair. The upper contact surface 231*a* may be disposed between the pair of protrusions 231*b* and the pair of protrusions 231*b* may be connected to each other. In addition, the upper contact surface 231*a* may be formed to extend from the outer end of the protrusion 231*b* while forming a curved surface.

On the other hand, the upper support plate 231 may further include an upper guide surface 231*c* bent and extended upward from the outer end of the upper contact surface 231*a* to guide the assembly of the water supply tube 84.

Accordingly, when the water supply tube 84 is fitted in a direction perpendicular to the third side 211*d*, the upper support plate 231 is elastically deformed like a cantilever beam such that the water supply tube 84 is inserted and coupled to the upper support plate 231.

The lower support plate 232 may include a lower contact surface 232*a* formed to have a curved surface so as to be in surface contact with the lower portion of the outer peripheral surface of the water supply tube 84. In this case, the lower contact surface 232*a* may be formed to have a curvature corresponding to the curvature of the outer peripheral surface of the water supply tube 84.

In addition, the lower support plate 232 may further include a lower supporter 232*b* extending from the lower surface of the bottom surface 211*a* and the third side 211*d* and connected to the lower contact surface 232*a* to support the lower contact surface 232*a*. In this case, the lower supporter 232*b* may extend to protrude in the vertical direction from the bottom surface 211*a* and the third side 211*d*, and two lower supporters 232*b* may constitute a pair. The lower contact surface 232*a* may be disposed between the pair of lower supporters 232*b* and the pair of lower supporters 232*b* may be connected to each other. In addition, the lower contact surface 232*a* may be formed to extend from the outer end of the lower supporter 232*b* while forming a curved surface.

On the other hand, the lower support plate 232 may further include a lower guide surface 232*c* bent and extended downward from the outer end of the lower contact surface 232*a* to guide the assembly of the water supply tube 84.

Accordingly, when the water supply tube 84 is fitted in a direction perpendicular to the third side 211*d*, the lower support plate 232 is elastically deformed like a cantilever beam such that the water supply tube 84 is inserted and coupled to the upper support plate 231.

As a result, the water supply tube 84 may be fitted and coupled between the upper support plate 231 and the lower support plate 232, and the upper contact surface 231*a* and the lower contact surface 232*b* may wrap the outer peripheral surface of the water supply tube 84. Therefore, the accumulator 200 of the present disclosure may be supported on the water supply tube 84 by the supporter 230 to prevent the accumulator 200 from being detached from a mount position due to an external impact or the like and maintain the arrangement of the steam pipe 92 and the water supply tube 84.

Figure 7:
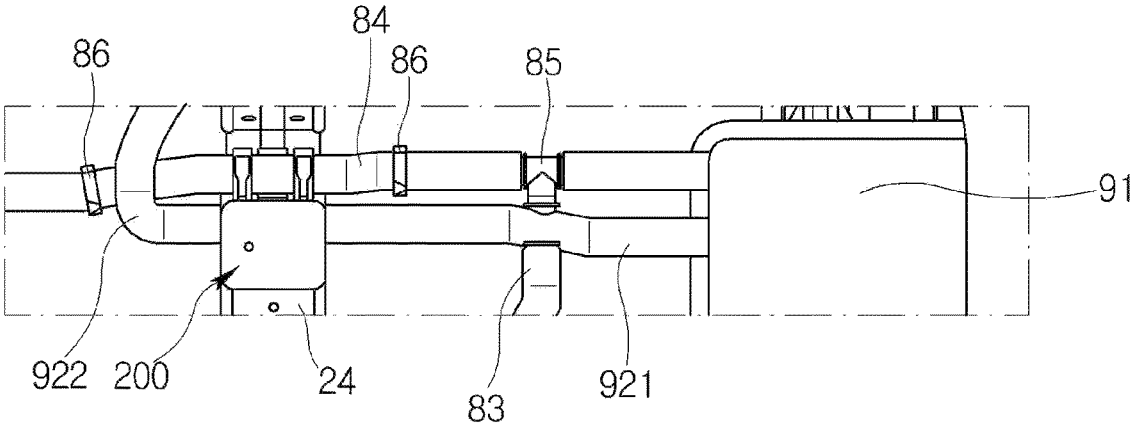
FIG. 7 is a view for describing a state in which an accumulator is mounted in a a laundry dryer according to an embodiment of the present disclosure.
Figure 8:
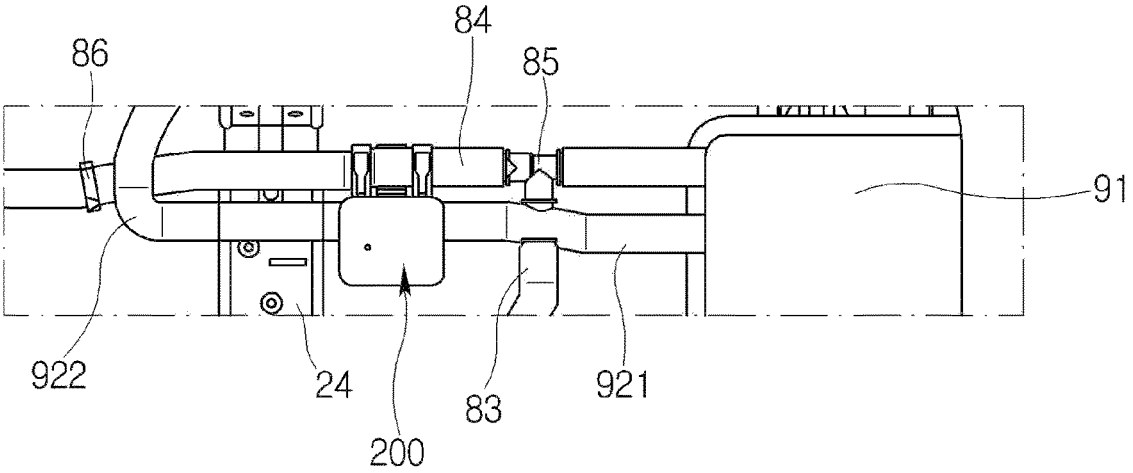
FIG. 8 is a view for describing another state in which an accumulator is mounted in a laundry dryer according to an embodiment of the present disclosure.
Figure 9:
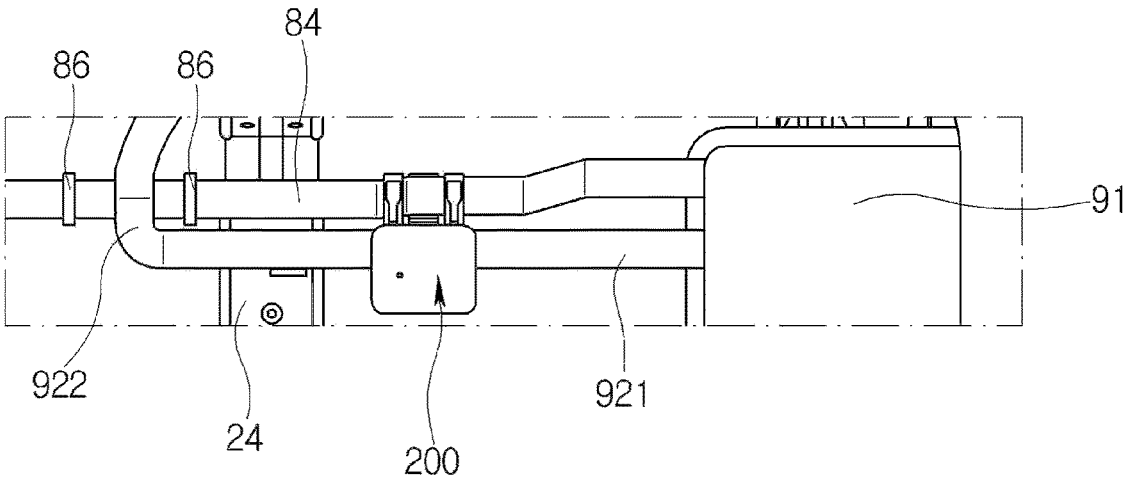
FIG. 9 is a view for describing still another state in which an accumulator is mounted in a laundry dryer according to an embodiment of the present disclosure.

FIG. 7 is a view for describing a state in which an accumulator is mounted in a a laundry dryer according to an embodiment of the present disclosure, FIG. 8 is a view for describing another state in which an accumulator is mounted in a laundry dryer according to an embodiment of the present disclosure, and FIG. 9 is a view for describing still another state in which an accumulator is mounted in a laundry dryer according to an embodiment of the present disclosure.

A method of mounting the accumulator 200 in the laundry dryer 1 according to an embodiment of the present disclosure and a position at which the accumulator 200 is mounted will be described below with reference to FIGS. 1 to 3 and 7 to 9.

First, the laundry dryer 1 of the present disclosure may further include an upper frame 24 disposed in the upper portion of the drum 20 to support the cabinet 10. According to an embodiment, the upper frame 24 may be coupled to the first supporter 22 and the second supporter 23, or may be coupled to the front panel 11 and the rear panel 12. Accordingly, the upper frame 24 may support the laundry dryer 1.

In addition, in the laundry dryer 1 of the present disclosure, the steam pipe 92 may include a first steam pipe 921 connecting the steam generator 91 and the accumulator 200 and a second steam pipe 922 connecting the accumulator 200 and the steam nozzle 93.

In this case, the steamer 90 of the present disclosure may receive water through the external water supplier 82 as well as the internal water supplier 81 as needed and supply steam to the inside of the drum body 21. Therefore, the laundry dryer lof the present disclosure may include a connector 85 for connecting the internal water supply tube 83 for supplying water in the internal water supplier 81 and the water supply tube 84 for supplying water in the external water supply 82. For example, the connector 85 may be a T-shaped connector.

In addition, the laundry dryer 1 of the present disclosure may further include a check valve 86 to prevent water flowing into the steam generator 91 from flowing reversely.

Referring to FIG. 7, the water supply tube 84 and the steam pipe 92 are disposed on the upper side of the upper frame 24, and the water supply tube 84 and the internal water supply tube 83 are connected to the connector 85 to communicate with each other. In this case, the first steam pipe 921 may be disposed on the upper side of the connector 85, and may be supported on the upper surface of the connector 85 according to installation conditions. In addition, one end of the second steam pipe 922 is coupled to the accumulator 200, and the other end is coupled to the steam nozzle 93. The middle of the steam pipe 922 may be bent due to the positional relationship between the accumulator 200 and the steam nozzle 93.

In this arrangement, two check valves 86 are installed on the water supply tube 84 to prevent backflow. That is, the water supply tube 84 is divided into three tubes, which are coupled to communicate with each other through the check valves 86. In this case, the accumulator 200 needs be coupled to the first steam pipe 921 and the second steam pipe 922, and be supported by holding the water supply tube 84. Under these installation conditions, it is most stable for the accumulator 200 to hold and support the water supply tube 84 disposed between the two check valves 86, and the accumulator 200 is preferably arranged on the upper frame 24 when considering the arrangement and mutual interference between the water supply tube 84, the internal water supply tube 83, and the steam tube 92.

On the other hand, another installation condition of the present disclosure is shown in FIG. 8. In this installation condition, instead of one check valve 86 being installed on the water supply tube 84, a check valve may be built in the connector 85. That is, the water supply tube 84 is divided into two tubes, which are coupled to communicate with each other through the check valves 86. Under the installation conditions, the water supply tube 84 between the check valve 86 and the connector 85 may have a relatively long length compared to the water supply tube 84 shown in FIG. 7, and the range of the space in which the accumulator 200 is able to be disposed may become larger. Accordingly, the accumulator 200 may be disposed above the upper frame 24, or may be alternatively disposed in a space between the internal water supply pipe 83 and the upper frame 24.

On the other hand, another installation condition of the present disclosure is shown in FIG. 9. In the installation condition, the internal water supply tube 83 and the connector 85 are absent. In addition, two check valves 86 are installed in the water supply tube 84. Under these installation conditions, two check valves 86 may be disposed (beyond) on the outside of the upper frame 24 with respect to the steam generator 91. Accordingly, the water supply tube 84 between the check valve 86 and the steam generator 91 may have the longest length compared to FIGS. 7 and 8, and the range of the space where the accumulator 200 is able to be disposed may be maximized. Accordingly, the accumulator 200 may be disposed on the upper frame 24, or may be alternatively disposed between the steam generator 91 and the upper frame 24.

Figure 10:
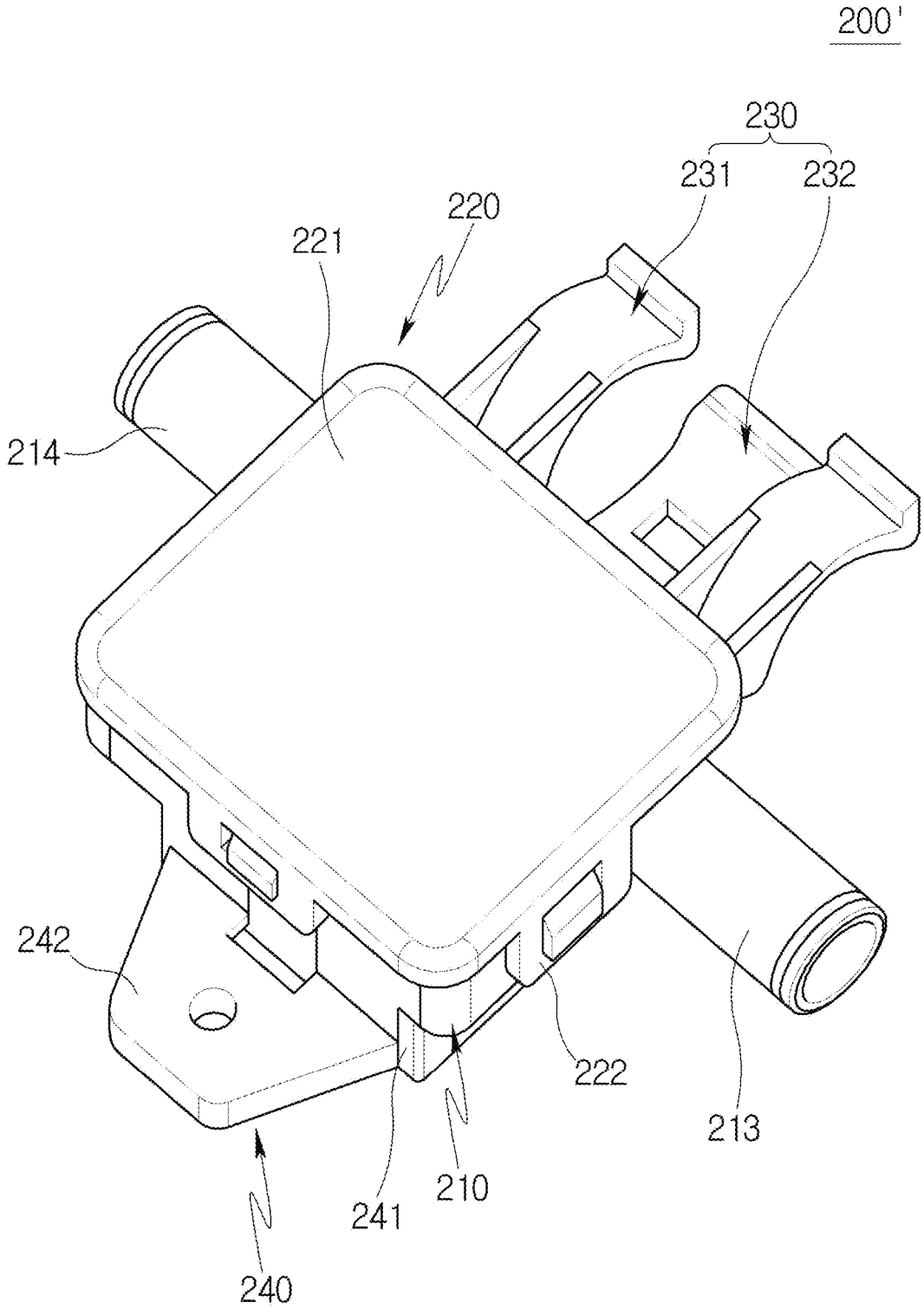
FIG. 10 is a perspective view for describing a structure of an accumulator in a laundry dryer according to a second embodiment of the present disclosure.
Figure 11:
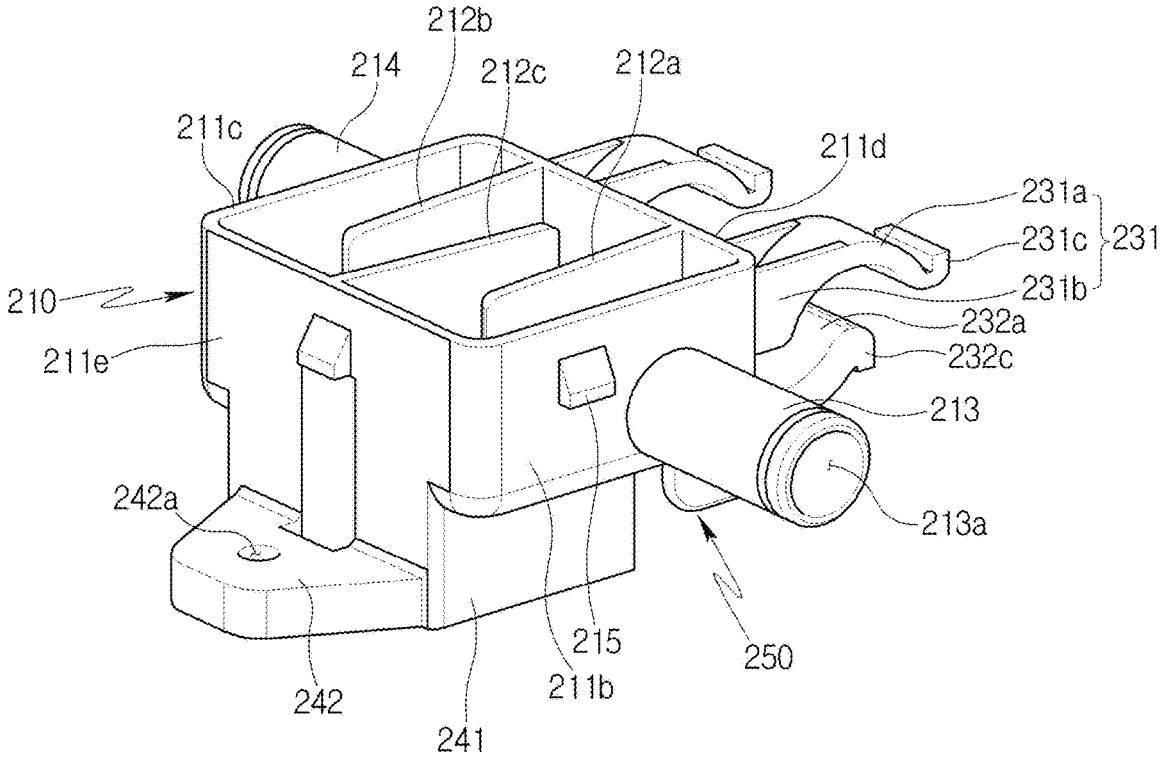
FIG. 11 is a perspective view for describing a base of an accumulator in the laundry dryer according to the second embodiment of the present disclosure.
Figure 12:
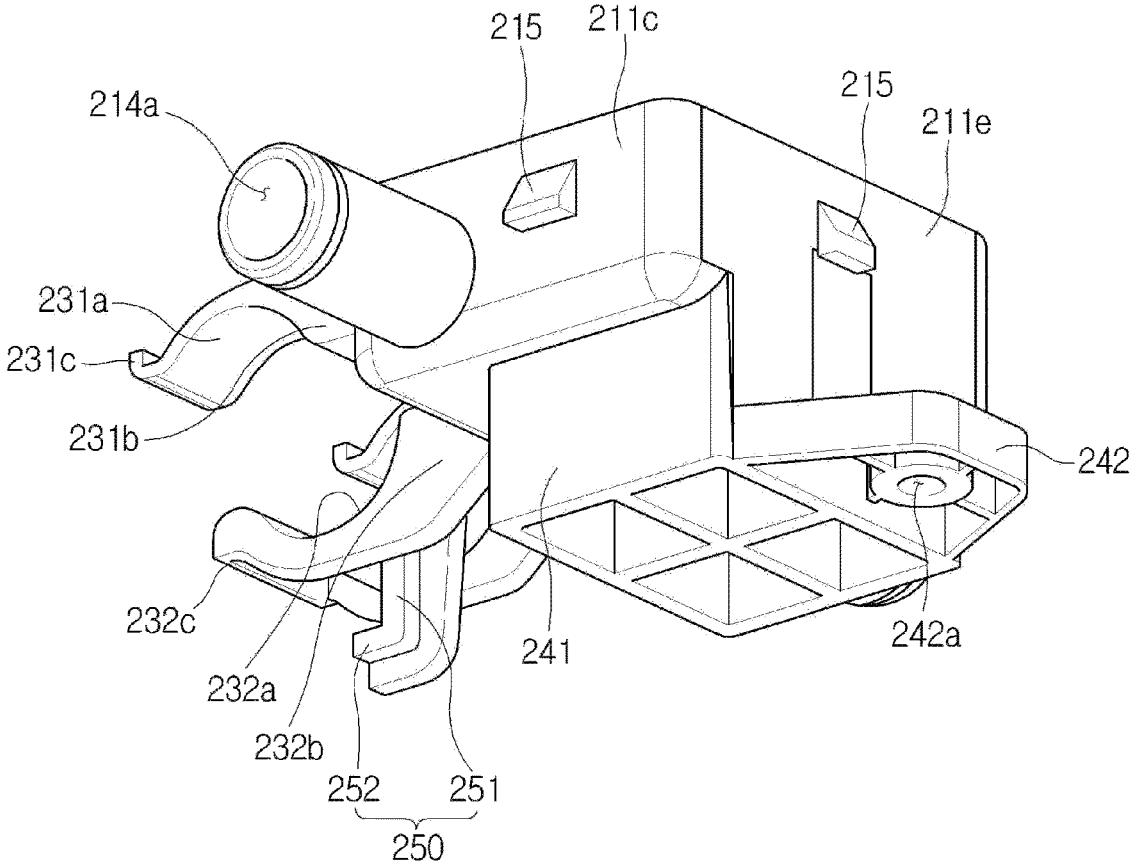
FIG. 12 is a perspective view showing the base of the accumulator in the laundry dryer according to the second embodiment of the present disclosure when viewed from another direction.
Figure 13:
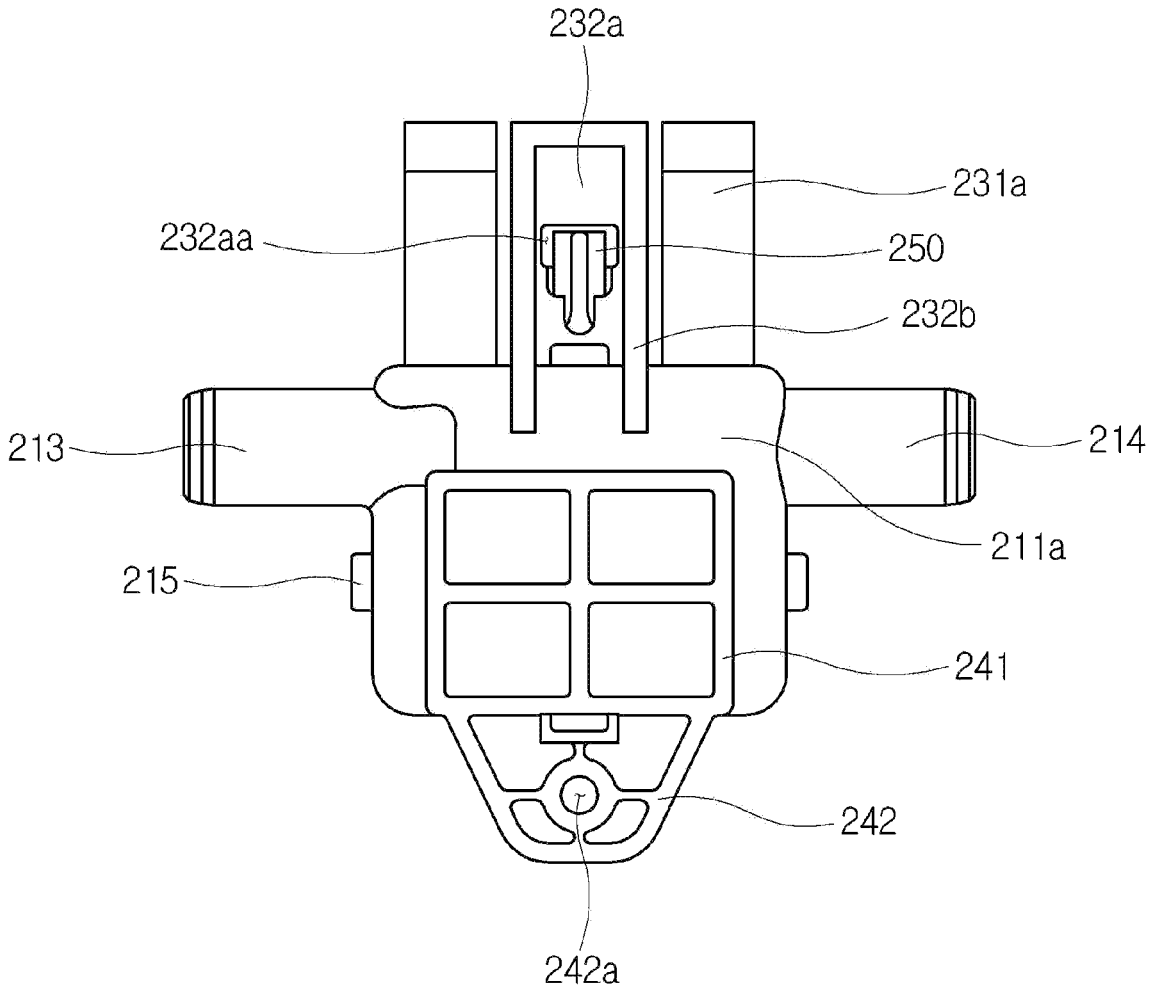
FIG. 13 is a bottom view for describing the base of the accumulator in the laundry dryer according to the second embodiment of the present disclosure.
Figure 14:
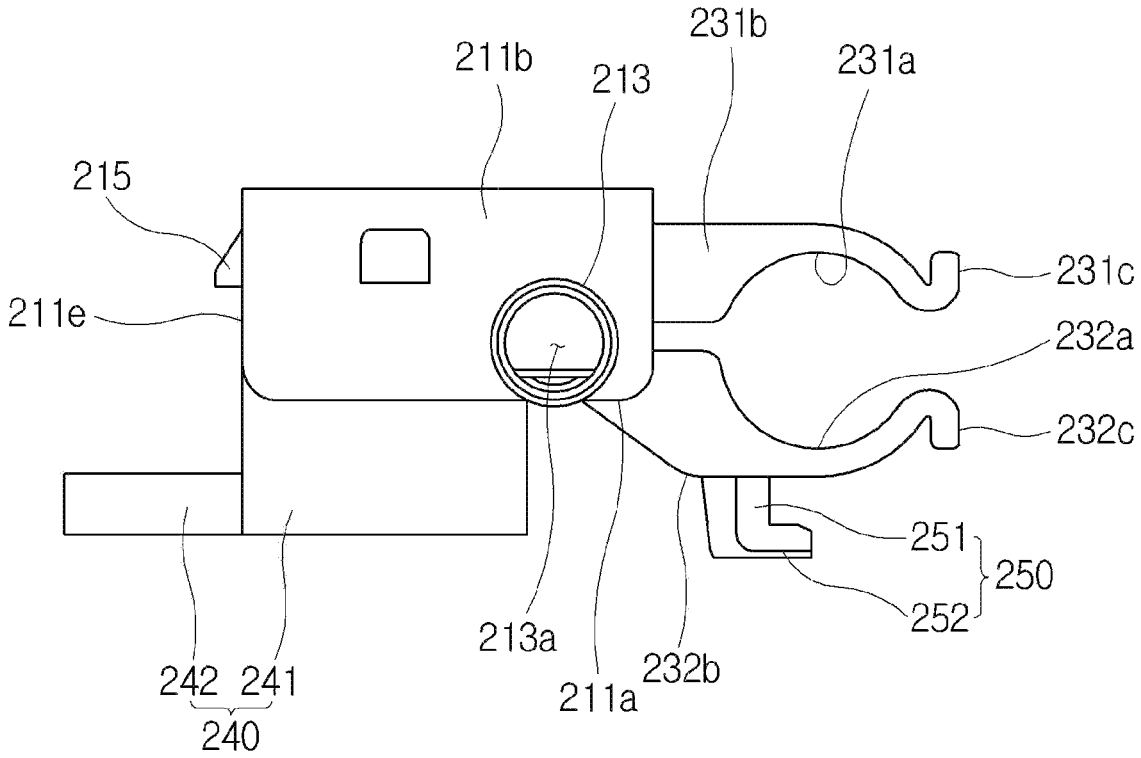
FIG. 14 is a side view for describing the base of the accumulator in the laundry dryer according to the second embodiment of the present disclosure.
Figure 15:
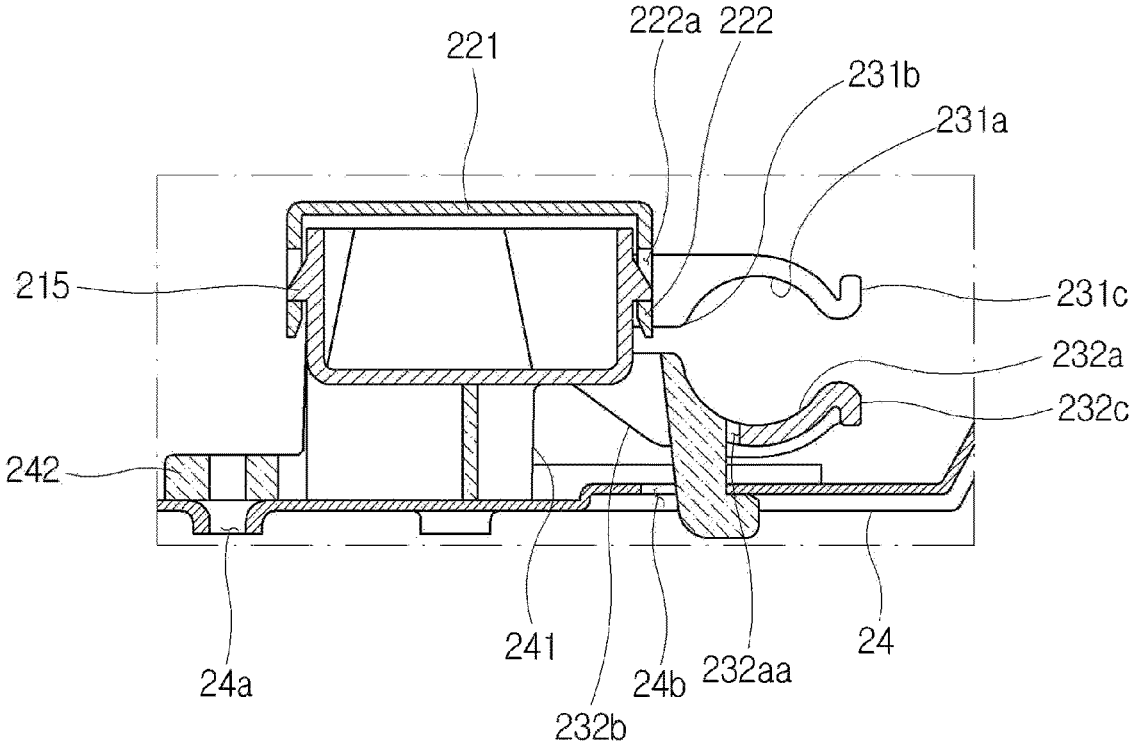
FIG. 15 is a cross-sectional view for describing installation of an accumulator in the laundry dryer according to the second embodiment of the present disclosure.

FIG. 10 is a perspective view for describing a structure of an accumulator in a laundry dryer according to a second embodiment of the present disclosure, FIG. 11 is a perspective view for describing a base of an accumulator in the laundry dryer according to the second embodiment of the present disclosure, FIG. 12 is a perspective view showing the base of the accumulator in the laundry dryer according to the second embodiment of the present disclosure when viewed from another direction, FIG. 13 is a bottom view for describing the base of the accumulator in the laundry dryer according to the second embodiment of the present disclosure, FIG. 14 is a side view for describing the base of the accumulator in the laundry dryer according to the second embodiment of the present disclosure, and FIG. 15 is a cross-sectional view for describing installation of an accumulator in the laundry dryer according to the second embodiment of the present disclosure.

In the present embodiment, the structure and effect of the accumulator 200 according to an embodiment of the present disclosure are quoted because they are the same as those of the accumulator 200 according to the present embodiment, except for parts specifically mentioned in order to avoid overlapping description.

In the present disclosure, in the accumulator 200, the gas-liquid separation effect may be increased when the inlet port 213 is disposed higher than the steam outlet 91*a* of the steam generator 91. That is, since the gaseous steam tends to flow upward along the first steam pipe 921, and the condensed water separated from the steam tends to flow downward in the gravity direction by gravity, when the height of the inlet port 213 is higher than the height of the steam outlet 91*a* where steam is generated, the flow efficiency of steam may be improved, and the separation and recovery efficiency of condensed water may be improved.

However, the accumulator 200 according to an embodiment of the present disclosure has a limitation in that the height of the inlet port 213 may not be maintained higher than the height of the steam outlet 91*a*.

To solve this issue, the accumulator 200 according to the second embodiment of the present disclosure additionally has a structure for maintaining the height of the inlet port 213 higher than the height of the steam outlet 91*a*. Details related thereto will be described later.

Referring to FIGS. 10 to 15, in the present embodiment, the accumulator 200 may further include a fixing portion 240 extending downward from the bottom surface 211*a* of the base 210 to support the base 210 and coupled to the upper frame 24.

Specifically, the fixing portion 240 may include a height adjustment portion 241 extending downward from the bottom surface 211*a* and a fixing plate 242 extending to protrude from the sidewall surface of the height adjustment portion 241.

The height adjustment portion 241 is formed to extend in the form of a pillar having a predetermined height (h) in order to guide the flow direction of steam and condensed water, and may adjust the height of the base 210.

For example, the height adjustment portion 241 may be formed to extend downward from the lower surface of the bottom surface 211*a* in the form of a square pillar. In this case, the height adjustment portion 241 may be formed as a hollow pillar in order to reduce the overall weight, or a grille plate for supporting the interior of the hollow pillar may be formed.

The fixing plate 242 may be formed to protrude from the sidewall surface of the height adjustment portion 241. In addition, a fixing hole 242*a* for fixed coupling may be formed in the fixing plate 242.

For example, the fixing plate 242 may be formed to protrude from the outer surface of the height adjustment portion 241 forming a continuous surface with the fourth side 211*e*, and have a width gradually decreasing as the fixing plate 242 protrudes from the outer surface of the height adjustment portion 241 and the form of a plate having a predetermined thickness. In this case, the lower surface of the fixing plate 242 may form the same plane as the lower end of the height adjustment portion 241. On the other hand, the fixing plate 242 may be further formed with a rectangular hole for the convenience of manufacturing at a position vertically below the cover coupling protrusion 215.

Through this configuration, in the present embodiment, the fixing plate 242 is seated on the upper frame 24, the fixing hole 242*a* is disposed on a screw hole 24*a* of the upper frame 24, and the accumulator 200 is fixed to the upper frame 24 by using for fixing members, such as screws. In addition, the height of the inlet port 213 may be maintained higher than the height of the steam outlet 91*a* by the height of the height adjustment portion 241.

On the other hand, the accumulator 200 of the present embodiment may further include an assembly hook 250 extending from the lower portion of the supporter 230 and supported by being caught by the upper frame 24.

Specifically, the assembly hook 250 may include a pillar portion 251 extending to protrude downward from the outer surface (lower surface) of the lower contact surface 232*a* in the shape of a pillar and a catching portion 252 bent and extended from the pillar portion 251.

For example, the pillar portion 251 may have a rectangular pillar shape extending in a direction parallel to the axial direction (which may be the direction of a flow path) of the inlet port 213 or the outlet port 214, and include a rib for reinforcement of the square pillar, the rib being formed to protrude from the surface of the rectangular pillar in the direction of the third side 211*d*. That is, the pillar portion 251 may be formed in the shape of a polygonal pillar having a cross sectional surface similar to a T-shape.

Meanwhile, the catching portion 252 may be bent and extended from the lower end of the pillar portion 251 toward the outside (in the direction opposite to the direction in which the fixing portion 240 is disposed).

Meanwhile, in the present embodiment, a rectangular hole 232*aa* may be further formed in the lower contact surface 232*a* for the convenience of manufacturing the assembly hook 250.

With this configuration, in the present embodiment, when the accumulator 200 is rotated around a point where the upper frame 24 and the catching portion 252 are in contact with each other as an axis after the catching portion 252 is inserted into the assembly hole 24*b* of the upper frame 24, the positions of the fixing hole 242 and the screw hole 24*a* are matched to increase the assembly. In addition, when the fixing portion 240 is fixedly coupled to the upper frame 24, the catching portion 252 serves as a kind of stopper, thereby preventing the accumulator 200 from rotating or being separated from the upper frame 24.

Figure 16:
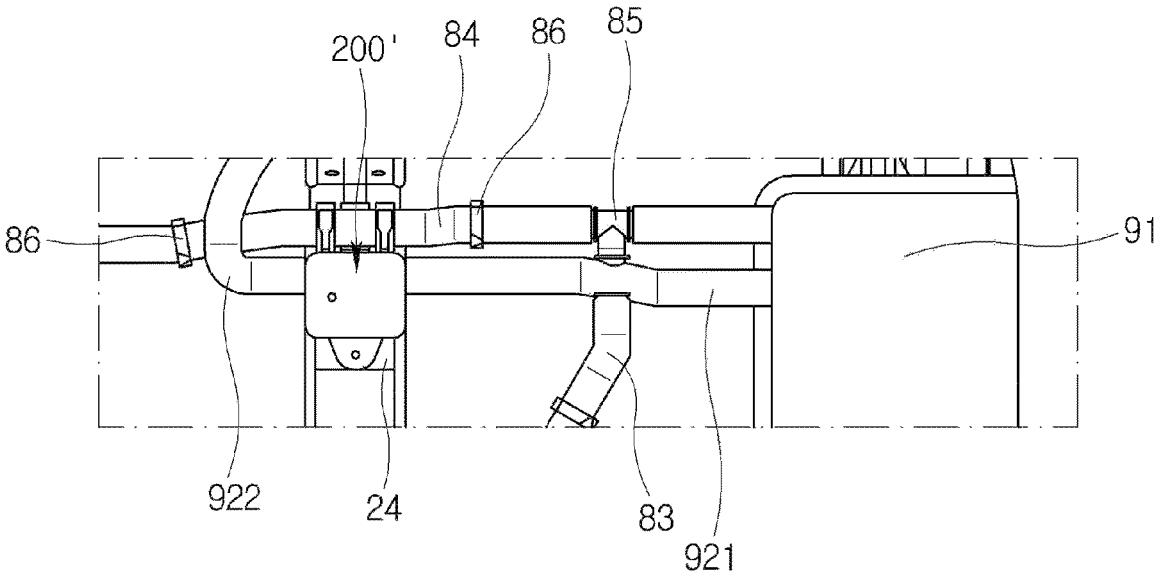
FIG. 16 is a view for describing a state in which the accumulator is mounted in the laundry dryer according to the second embodiment of the present disclosure.

FIG. 16 is a view for describing a state in which the accumulator is mounted in the laundry dryer according to the second embodiment of the present disclosure.

Referring to FIG. 16, the water supply tube 84 and the steam pipe 92 are disposed on the upper side of the upper frame 24, and the water supply tube 84 and the internal water supply tube 83 are connected to the connector 85 to communicate with each other. In this case, the first steam pipe 921 may be disposed on the upper side of the connector 85, and may be supported on the upper surface of the connector 85 according to installation conditions. In addition, one end of the second steam pipe 922 is coupled to the accumulator 200, and the other end is coupled to the steam nozzle 93. The middle of the steam pipe 922 may be bent due to the positional relationship between the accumulator 200 and the steam nozzle 93.

In this arrangement, two check valves 86 are installed on the water supply tube 84 to prevent backflow. That is, the water supply tube 84 is divided into three tubes, which are coupled to communicate with each other through the check valves 86. In this case, the accumulator 200 needs be coupled to the first steam pipe 921 and the second steam pipe 922, and be supported by holding the water supply tube 84. Under these installation conditions, the supporter 230 holds the water supply tube 84 disposed between the two check valves 86 and fixedly couples the fixing plate 242 to the upper frame 24 after the catching portion 252 is inserted into the upper frame 24. Finally, by connecting the first steam pipe 921 and the second steam pipe 922 to the accumulator 200, the accumulator can be easily mounted.

Therefore, according to the present embodiment, it is possible to improve the mounting of the accumulator 200. In addition, the height of the inlet port 213 may be maintained higher than the height of the steam outlet 91*a* without a special fixing process, thus improving the gas-liquid separation performance and preventing the condensed water from flowing into the drum 20.

Figure 17:
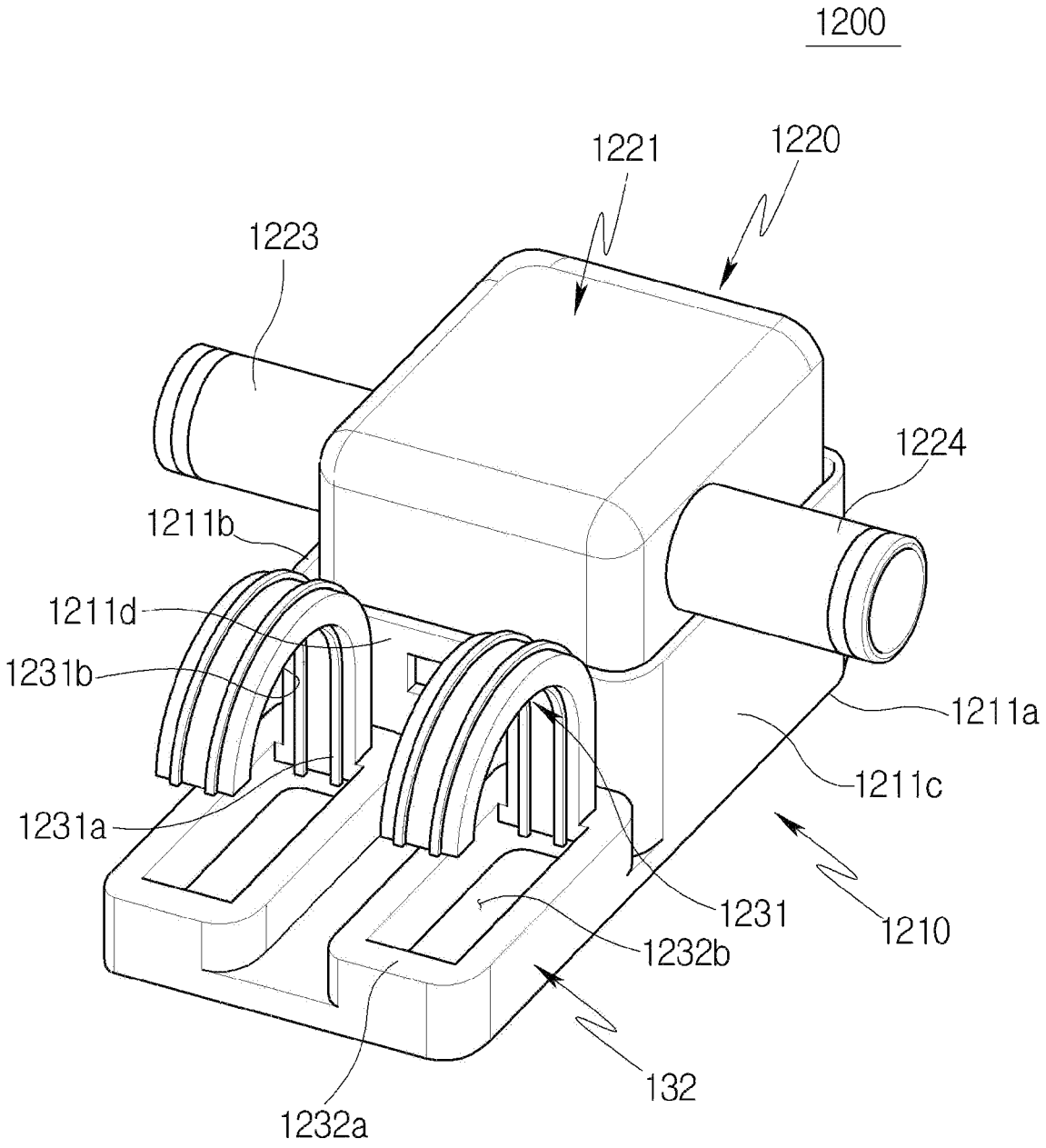
FIG. 17 is a perspective view for describing a structure of an accumulator in a laundry dryer according to a third embodiment of the present disclosure.
Figure 18:
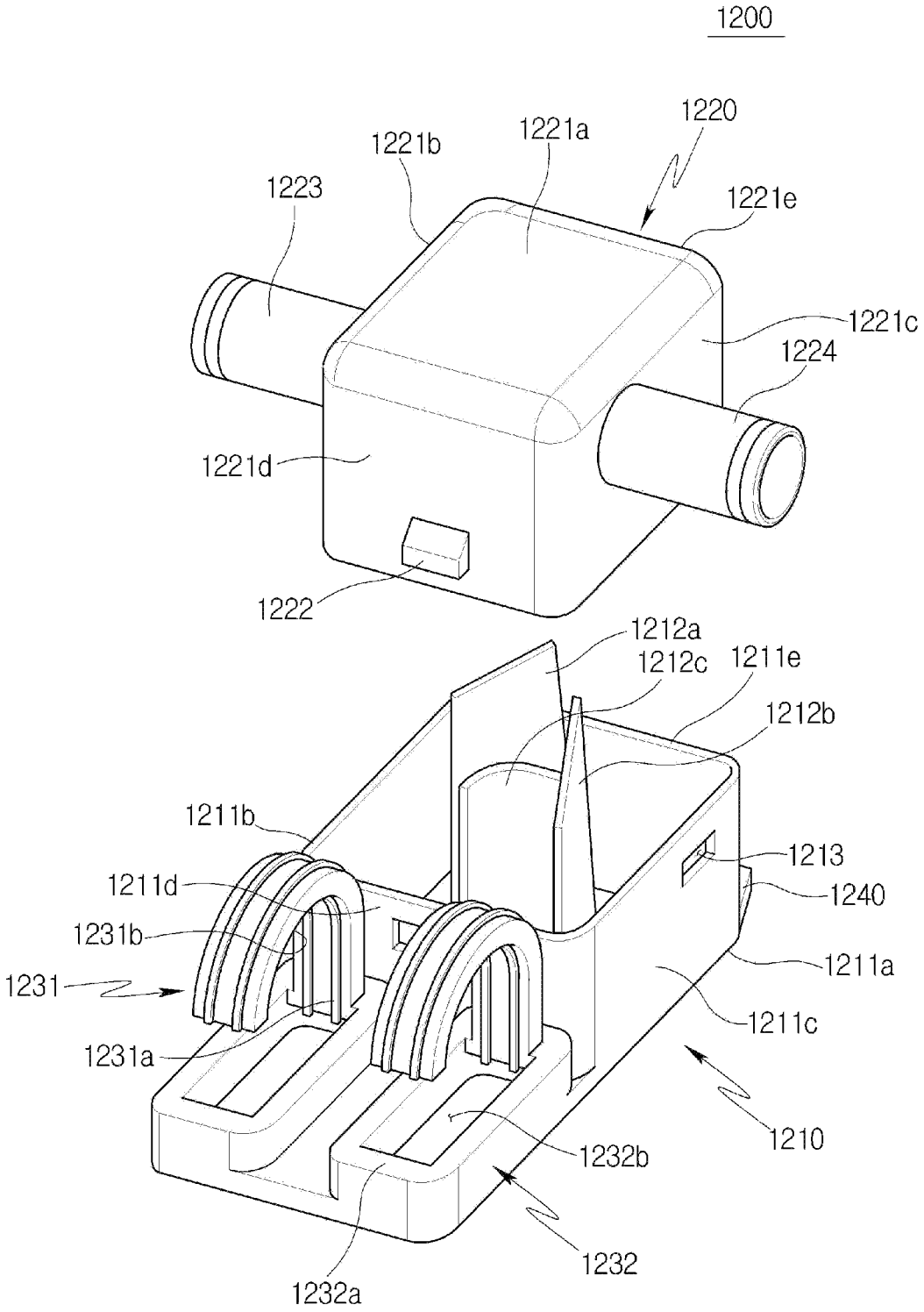
FIG. 18 is an exploded perspective view of FIG. 17.

FIG. 17 is a perspective view for describing a structure of an accumulator in a laundry dryer according to a third embodiment of the present disclosure, and FIG. 18 is an exploded perspective view of FIG. 17.

An accumulator 1200 of the present disclosure is installed on the steam pipe 92 and supported by holding the water supply tube 84 of the water supplier 80 to separate condensed water from the steam flowing along the steam pipe 92.

In this case, the accumulator 1200 of the present disclosure may include a base 1210, a cover 1220, and a supporter 1230.

The base 1210 may form a lower case of the accumulator 1200 of the present disclosure, and a space for storing condensed water separated from steam may be formed in the base 210.

Specifically, the base 1210 may include a base body 1211 and a condensate separator plate 1212.

The base body 1211 may form a lower exterior of the accumulator 1200. For example, the base body 1211 may be formed in a box shape.

Specifically, the base body 1211 may have a bottom surface 1211*a* formed on the lower side in the direction of gravity, and the outer ends of the bottom surface 1211*a* may be connected while a first side 1211*b*, a second side 1211*c*, a third side 211*d* and a fourth side 1211*e* surround the bottom surface 1211*a*. That is, a side wall made of the first side 1211*b*, the second side 1211*c*, the third side 1211*d* and the fourth side 1211*e* is formed at the outer ends of the bottom surface 1211*a* to form a space capable of storing or receiving condensed water.

For example, the first side 1211*b* may refer to a surface disposed in a direction in which steam is introduced.

In addition, the second side 1211*c* may refer to a surface disposed in a direction in which steam is discharged.

The third side 1211*d* may refer to a surface connecting the first side 1211*b* and the second side 1211*c*, and the supporter 1230 may be formed to protrude from the outer surface.

The fourth side 1211*e* may refer to a surface that connects the first side 1211*b* and the second side 1211*c* and is disposed at a position facing the third side 1211*d*.

The condensate separator plate 1212 may be formed inside the base body 1211 and may extend to protrude upward from the bottom surface 1211*a* of the base body 1211.

As an example, the condensate separator plate 1212 may include three separator plates extending to protrude from the bottom surface 1211*a*.

Specifically, the condensate separator plate 1212 may include a first separator plate 1212*a* formed to be inclined at a predetermined angle with respect to the sidewall surface of the base body 1211 to guide the flow of steam generated by the steam generator 91. For example, the first separator plate 1212*a* may be disposed close to the first side 1211*b*, and may be disposed to correspond to the position of the inlet port 1223 of the cover 1220, which will be described later.

In addition, the condensate separator plate 1212 may further include a second separator plate 1212*b* formed to be inclined at a predetermined angle with the sidewall surface of the base body 1211 to guide the flow of steam discharged to the steam nozzle 93. For example, the second separator plate 1212*b* may be disposed at a position close to the second side 1211*c*, and may be disposed to correspond to a position of the outlet port 1224 of the cover 1220, which will be described later.

In addition, the condensate separator plate 1212 may further include a third separator plate 1212*c* disposed between the first separator plate 1212*a* and the second separator plate 1212*b* and formed to have a curved shape. For example, the third separator plate 1212*c* may be disposed to face the third side 1211*d*, and may be formed to have a concave curved shape when viewed from the third side 1211*d*.

With this configuration, the cross-sectional area of the flow path through which the introduced steam passes may be continuously changed. Accordingly, the flow rate of steam may be changed, adiabatic expansion or compression may occur, and efficiency of separation of condensed water which is contained in steam may be improved.

A hook receiving hole 1213 for accommodating a cover coupling protrusion 1222 to be described later may be formed in a sidewall of the base body 1211.

For example, the hook receiving hole 1213 is formed in the first side 1211*b*, the second side 1211*c*, the third side 1211*d*, and the fourth side 1211*e*, and may be formed in the form of a square hole so as to accommodate the cover coupling protrusion 1222.

Meanwhile, the cover 1220 of the present disclosure may be coupled to the base 1210 to form a flow path through which steam flows.

The cover 1220 may form an upper case of the accumulator 1200 of the present disclosure.

The cover 1220 may include a cover body 1221, a cover coupling protrusion 1222, an inlet port 1223, and an outlet port 1224.

The cover body 1221 may cover the base 1210 to form a flow path through which steam flows. Specifically, the cover body 1221 may include a cover surface 1221*a* that covers the base 1210 and sidewalls that surround the periphery of the cover surface 1221*a*. In this case, the sidewalls may include a steam inlet surface 1221*b* on which the inlet port 1223 is formed, a steam outlet surface 1221*c* on which the outlet port 1224 is formed, a first connection surface 1221*d* connecting the steam inlet surface 1221*b* and the steam outlet surface 1221*c*, and a second connection surface 1221*e* formed to face the first connection surface 1221*d*.

For example, the cover body 1221 may be formed in the form of a box open downward, and may be formed to have a width and length smaller than the width and length of the base 1210 so as to be fitted and coupled to the inside of the base 1210.

Meanwhile, the cover coupling protrusion 1222 may be formed to protrude from the outer surface of the sidewall of the cover body 1221 and be coupled to the base 1210. For example, the cover coupling protrusion 1222 may be formed to protrude from the outer surfaces of the steam inlet surface 1221*b*, the steam outlet surface 1221*c*, the first connection surface 1221*d*, and the second connection surface 1221*e*. In this case, the cover coupling protrusion 1222 is preferably formed to protrude from at least two surfaces.

In the present embodiment, the cover coupling protrusion 1222 may be formed to include an inclined surface to be hook-coupled to the base 1210.

By the configuration described above, the cover 1220 is coupled to the base 1210 to form a space in which steam flows, thus preventing the steam from leaking to the outside.

In particular, in the present disclosure, a sealing member is further included in the base 1210 so that the space between the cover 1220 and the base 1210 may be sealed to prevent steam from leaking to the outside.

The inlet port 1223 extends to protrude from one outer surface of the cover body 1221 and is inserted into the first steam pipe 921, and steam generated from the steam generator 91 may be introduced into the inlet port 213.

For example, the inlet port 1223 extends to protrude from the first side 211*b* in a cylindrical shape, and a steam inlet flow path is formed in the inlet port 213 such that steam generated from the steam generator 91 is introduced into the space inside the base body 211.

In this case, the height of the inlet port 1223 is preferably disposed higher than the height of the steam outlet 91*a*. That is, in the present embodiment, the heights of the base 1210 and the cover 1220 may be formed to be higher than a predetermined height, so that the height of the inlet port 1223 may be higher than the height of the steam outlet 91*a*.

With this configuration, the gas-liquid separation efficiency of the accumulator 1200 of the present embodiment can be improved.

The outlet port 1224 is formed to protrude from the other outer surface of the cover body 1221, is inserted into the second steam pipe 922 to enable steam from which the condensed water is separated to be discharged to the steam nozzle 93.

For example, the outlet port 1224 may extend to protrude in a cylindrical shape from the second side 211*c*, and a steam outlet flow path is formed therein such that steam from which the condensed water has been separated is able to be discharged toward the steam nozzle 93.

In this case, the outlet port 1224 may be disposed higher than the inlet port 1223.

Accordingly, gaseous steam may be discharged through the steam outlet flow path. In contrast, the condensed water may not pass through the steam outlet flow path and may be collected in the internal space of the base body 1211 by gravity. Therefore, the condensed water may be blocked from being discharged toward the steam nozzle 93 by the configuration as described above.

The supporter 1230 of the present embodiment may extend to protrude from the outer surface of the base 1210 to hold the outer peripheral surface of the water supply tube 84. For example, the supporter 1230 may extend to protrude from the outer surface of the third side 1211*d*, and may be formed such that the water supply tube 84 is inserted into the supporter 230 be supported by each other.

The supporter 1230 may include a lower support plate 1232 extending to protrude from the outer surface of the base body 1211, and an upper support plate 1231 protruding from the lower support plate 1232 and surrounding the upper outer peripheral surface of the water supply tube 84.

For example, the lower support plate 1232 may be formed to protrude from the outer surface of the third side 1211*d* in a plate shape 1232*a*, and may include a rectangular groove 1232*b* formed therein at a position corresponding to the position of the upper support plate 1231. The lower surface of the lower support plate 1232 may be formed on the same plane as the lower surface of the bottom surface 1211*a*.

Accordingly, the lower support plate 1232 may be seated on the upper frame 24 together with the bottom surface 1211*a*.

The upper support plate 1231 may protrude from the lower support plate 1232 and be formed to have a curved surface to surround the upper outer peripheral surface of the water supply tube 84.

For example, the upper support plate 1231 may include a vertical protrusion 1232*a* protruding upward from the lower support plate 1232, and a hook portion 1232*b* formed to extend from the vertical protrusion 1232*a* in a curved shape similar to a hook or gaff so as to hang and support the water supply tube 84. In this case, the curvature of the hook portion 1232*b* may be formed to have a curvature corresponding to the curvature of the outer peripheral surface of the water supply tube 84. Further, a plurality of ribs may be formed to protrude from the upper support plate 1231 to increase the coupling force with the water supply pipe 84.

In this configuration, the upper support plate 231 and the water supply tube 84 may be supported by each other.

As a result, the water supply tube 84 may be fitted and coupled between the upper support plate 1231 and the lower support plate 1232. Therefore, the accumulator 1200 of the present embodiment may be supported on the water supply tube 84 by the supporter 1230 to prevent the accumulator 200 from being detached from a mount position due to an external impact or the like and maintain the arrangement of the steam pipe 92 and the water supply tube 84.

The fixing portion 1240 of the present embodiment may extend to protrude from the outer surface of the base 1210, and have a fixing hole for fixed coupling.

For example, the fixing portion 1240 may be formed to protrude from the fourth side 1211*e*, and may have a width gradually decreasing as the fixing portion 1240 protrudes from the fourth side 1211*e* and a plate shape having a predetermined thickness. In this case, the lower surface of the fixing portion 1240 may be formed on the same plane as the lower surface of the bottom surface 1211*a*.

That is, the lower support plate 1232, the bottom surface 1211*a*, and the lower surface of the fixing portion 1240 may be formed on the same plane to achieve stably mounting on the upper frame 24.

Through this configuration, in the present embodiment, the fixing portion 1240 is seated on the upper frame 24, a fixing hole is disposed on a screw hole 24*a* of the upper frame 24, and the accumulator 1200 is fixed to the upper frame 24 by using for fixing members, such as screws.

Figure 19:
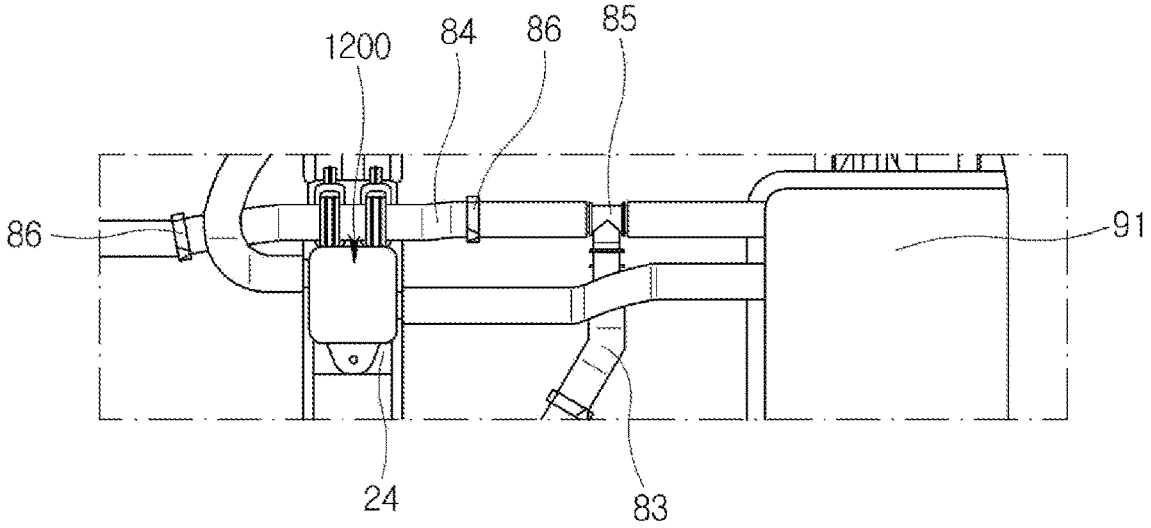
FIG. 19 is a view for describing a state in which an accumulator is mounted in a laundry dryer according to a third embodiment of the present disclosure.

FIG. 19 is a view for describing a state in which the accumulator is mounted in the laundry dryer according to the third embodiment of the present disclosure.

Referring to FIG. 19, the water supply tube 84 and the steam pipe 92 are disposed on the upper side of the upper frame 24, and the water supply tube 84 and the internal water supply tube 83 are connected to the connector 85 to communicate with each other. In this case, the first steam pipe 921 may be disposed on the upper side of the connector 85, and may be supported on the upper surface of the connector 85 according to installation conditions. In addition, one end of the second steam pipe 922 is coupled to the accumulator 1200, and the other end is coupled to the steam nozzle 93. The middle of the steam pipe 922 may be bent due to the positional relationship between the accumulator 1200 and the steam nozzle 93.

In this arrangement, two check valves 86 are installed on the water supply tube 84 to prevent backflow. That is, the water supply tube 84 is divided into three tubes, which are coupled to communicate with each other through the check valves 86. In this case, the accumulator 1200 needs be coupled to the first steam pipe 921 and the second steam pipe 922, and be supported on the water supply tube 84. Under these installation conditions, it is most stable for the accumulator 1200 to be supported on the water supply tube 84 disposed between the two check valves 86, and the accumulator 1200 is preferably arranged on the upper frame 24 when considering the arrangement and mutual interference between the water supply tube 84, the internal water supply tube 83, and the steam tube 92.

Therefore, according to the present embodiment, the mounting of the accumulator 1200 may be improved through the supporter 1230 and the fixing portion 1240. In addition, the height of the inlet port 1223 may be maintained higher than the height of the steam outlet 91*a* by forming the inlet port 1223 in the cover 1220, thus improving the gas-liquid separation performance and preventing the condensed water from flowing into the drum 20.

Although the present disclosure has been described in detail through specific examples, it is intended to describe the present disclosure in detail, and the present disclosure is not limited thereto, and it is clear that the present disclosure can be modified or improved by those skilled in the art within the technical spirit of the present disclosure.

All simple modifications or changes of the present disclosure fall within the scope of the present disclosure, and the specific protection scope of the present disclosure will become apparent from the appended claims.

The invention claimed is:

1. A laundry dryer comprising:

a cabinet that defines an appearance of the laundry dryer;

a drum rotatably disposed in the cabinet and configured to accommodate a subject to be dried;

a duct configured to re-supply air discharged from the drum to the drum;

a circulation fan configured to provide a flow force to air to move along the duct;

a heat exchanger provided on the duct and configured to perform heat exchange with air circulated along the duct;

a steamer configured to supply steam into the drum; and a water supplier comprising a water supply tube configured to supply water to the steamer, wherein the steamer comprises:

a steam generator configured to receive water from the water supplier and to generate steam by heating the received water, a steam nozzle connected to the steam generator and configured to supply steam from the steam generator into the drum;

a steam pipe that connects the steam generator and the steam nozzle and that is configured to carry the steam generated by the steam generator, and an accumulator disposed at the steam pipe and configured to separate condensed water from the steam flowing through the steam pipe, the accumulator comprising a supporter configured to hold an outer peripheral surface of the water supply tube.

2. The laundry dryer of claim 1, wherein the accumulator further comprises:

a base having a space formed therein to accommodate condensed water separated from steam; and a cover coupled to the base to form a flow path through which steam flows, and wherein the supporter extends to protrude from an outer surface of the base.

3. The laundry dryer of claim 2, wherein the base comprises:

a base body that has a box shape; and a condensate separator plate that is disposed inside of the base body and that extends to protrude upward from a bottom surface of the base body.

4. The laundry dryer of claim 3, wherein the steam pipe comprises:

a first steam pipe connecting the steam generator and the accumulator; and a second steam pipe connecting the accumulator and the steam nozzle, and wherein the base comprises:

an inlet port extending to protrude from a portion of an outer surface of the base body and being inserted into the first steam pipe, the inlet port being configured to receive the steam generated by the steam generator; and an outlet port extending to protrude from another portion of the outer surface of the base body and being inserted into the second steam pipe, the outlet port being configured to discharge steam from which condensed water has been separated to the steam nozzle.

5. The laundry dryer of claim 4, wherein the outlet port is disposed at a position higher than the inlet port with respect to the bottom surface of the base body.

6. The laundry dryer of claim 4, wherein the inlet port is disposed such that a portion of an inner peripheral surface of the inlet port is located lower than the bottom surface of the base body in a gravity direction.

7. The laundry dryer of claim 3, wherein the supporter comprises a support plate that protrudes from an outer surface of the base body and that is configured to be in surface contact with the outer peripheral surface of the water supply tube.

8. The laundry dryer of claim 7, wherein the base body comprises:

a first side disposed in a direction in which steam is introduced;

a second side disposed in a direction in which steam is discharged; and a third side connecting the first side and the second side, and wherein the support plate comprises an upper support plate including an upper contact surface that has a curved surface to be in surface contact with an upper portion of the outer peripheral surface of the water supply tube, the upper support plate extending from an outer surface of the third side.

9. The laundry dryer of claim 8, wherein the upper support plate further comprises a protrusion extending to protrude from the third side, and wherein the upper contact surface is formed to extend to be curved at an outer end of the protrusion.

10. The laundry dryer of claim 9, wherein the upper support plate is bent and extended upward from an outer end of the upper contact surface to guide assembly of the water supply tube.

11. The laundry dryer of claim 8, wherein the support plate comprises a lower support plate including a lower contact surface that has a curved surface to be in surface contact with a lower portion of the outer peripheral surface of the water supply tube, the lower support plate extending to protrude from a lower surface of the bottom surface.

12. The laundry dryer of claim 11, wherein the lower support plate further comprises a lower supporter formed to extend from the bottom surface and the third side and connected to the lower contact surface to support the lower contact surface.

13. The laundry dryer of claim 3, wherein the base comprises a cover coupling protrusion formed to protrude from the outer surface of the base body so as to be hook-coupled with the cover.

14. The laundry dryer of claim 13, wherein the cover comprises:

a cover body configured to cover the base, the cover body defining the flow path; and a coupler formed to extend from a sidewall of the cover body and having a hook receiving hole for accommodating the cover coupling protrusion.

15. The laundry dryer of claim 2, further comprising:

an upper frame disposed on an upper side of the drum and supporting the cabinet, wherein the accumulator further comprises a fixing portion that extends downward from a bottom surface of the base to support the base and that is coupled to the upper frame.

16. The laundry dryer of claim 15, wherein the fixing portion comprises:

a height adjustment portion extending downward from the bottom surface and adjusting a height of the base to guide a direction of flow of steam and condensed water; and a fixing plate extending to protrude from a sidewall surface of the height adjustment portion and having a fixing hole for being fixedly coupled to the upper frame.

17. The laundry dryer of claim 15, wherein the accumulator further comprises an assembly hook extending downward from a lower portion of the supporter and supported by being caught by the upper frame.

18. The laundry dryer of claim 3, wherein the supporter comprises a lower support plate that extends to protrude from an outer surface of the base body and that defines a same plane as the bottom surface of the base body.

19. The laundry dryer of claim 18, wherein the supporter comprises an upper support plate protruding from the lower support plate and extending while forming a curved surface to surround an upper outer peripheral surface of the water supply tube.

20. The laundry dryer of claim 3, wherein the condensate separator plate comprises:

a first separator plate formed to be inclined at a predetermined angle with a sidewall surface of the base body to guide flow of steam generated by the steam generator;

a second separator plate formed to be inclined at a predetermined angle with the sidewall surface of the base body to guide flow of steam discharged to the steam nozzle; and a third separator plate disposed between the first separator plate and the second separator plate and formed to have a curved shape.

* * * * *